US008217325B2

(12) United States Patent
Russell et al.

(10) Patent No.: US 8,217,325 B2
(45) Date of Patent: Jul. 10, 2012

(54) ELEVATED MICROWAVE HEATING CONSTRUCT

(75) Inventors: Mitchell W. Russell, Allenstown, NH (US); Bing Liu, Mississauga (CA); Laurence M. C. Lai, Mississauga (CA)

(73) Assignee: Graphic Packaging International, Inc., Marietta, GA (US)

( * ) Notice: Subject to any disclaimer, the term of this patent is extended or adjusted under 35 U.S.C. 154(b) by 477 days.

(21) Appl. No.: 11/519,469

(22) Filed: Sep. 12, 2006

(65) Prior Publication Data

US 2007/0087090 A1 Apr. 19, 2007

Related U.S. Application Data

(60) Provisional application No. 60/716,262, filed on Sep. 12, 2005, provisional application No. 60/723,827, filed on Oct. 5, 2005, provisional application No. 60/724,196, filed on Oct. 6, 2005, provisional application No. 60/736,442, filed on Nov. 14, 2005.

(51) Int. Cl.
*H05B 6/80* (2006.01)
*B65D 81/34* (2006.01)

(52) U.S. Cl. ..... 219/730; 426/113

(58) Field of Classification Search ..... 219/725–735, 219/634, 759; 426/109–114
See application file for complete search history.

(56) References Cited

U.S. PATENT DOCUMENTS

| | | | | |
|---|---|---|---|---|
| 1,513,608 | A | 10/1924 | Labombarde | |
| 3,865,301 | A * | 2/1975 | Pothier et al. | 229/5.82 |
| 4,192,540 | A | 3/1980 | Oliff | |
| 4,210,124 | A | 7/1980 | Husslein et al. | |
| 4,279,374 | A * | 7/1981 | Webinger | 229/120 |
| 4,505,391 | A | 3/1985 | Kuchenbecker | |
| 4,567,341 | A * | 1/1986 | Brown | 219/729 |
| 4,592,914 | A * | 6/1986 | Kuchenbecker | 426/107 |
| 4,705,929 | A | 11/1987 | Atkinson | |
| 4,775,771 | A | 10/1988 | Pawlowski | |
| 4,801,774 | A | 1/1989 | Hart | |
| 4,826,072 | A | 5/1989 | Hart | |
| 4,865,921 | A | 9/1989 | Hollenberg | |
| 4,877,932 | A | 10/1989 | Bernstein et al. | |
| 4,890,439 | A | 1/1990 | Smart | |
| 4,936,935 | A | 6/1990 | Beckett | |
| 4,960,598 | A | 10/1990 | Swiontek | |
| 4,963,240 | A | 10/1990 | Fukasawa et al. | |
| 4,963,424 | A | 10/1990 | Beckett | |
| 5,093,364 | A | 3/1992 | Richards | |
| 5,117,078 | A | 5/1992 | Beckett | |
| 5,144,107 | A | 9/1992 | Peleg | |

(Continued)

FOREIGN PATENT DOCUMENTS

EP 0 451 530 A2 10/1991

(Continued)

OTHER PUBLICATIONS

European Search Report dated May 23, 2011 for EP 11 00 2391.

*Primary Examiner* — Daniel L Robinson
(74) *Attorney, Agent, or Firm* — Womble Carlyle Sandridge & Rice, LLP

(57) ABSTRACT

Various blanks and constructs formed therefrom are provided. The various constructs include features for supporting a food item at an elevated position to enhance the heating, browning, and/or crisping of the food item in a microwave oven.

50 Claims, 22 Drawing Sheets

U.S. PATENT DOCUMENTS

| | | | | |
|---|---|---|---|---|
| 5,213,902 | A | 5/1993 | Beckett | |
| 5,221,419 | A | 6/1993 | Beckett | |
| 5,247,149 | A * | 9/1993 | Peleg | 219/729 |
| 5,260,537 | A | 11/1993 | Beckett | |
| 5,266,386 | A | 11/1993 | Beckett | |
| RE34,683 | E | 8/1994 | Maynard | |
| 5,340,436 | A | 8/1994 | Beckett | |
| 5,354,973 | A | 10/1994 | Beckett | |
| 5,357,086 | A * | 10/1994 | Turpin et al. | 219/732 |
| 5,400,460 | A | 3/1995 | Roeker et al. | |
| 5,410,135 | A | 4/1995 | Pollart | |
| 5,424,517 | A | 6/1995 | Habeger | |
| 5,519,195 | A | 5/1996 | Keefer | |
| 5,544,806 | A | 8/1996 | Anderson et al. | |
| 5,628,921 | A | 5/1997 | Beckett | |
| 5,672,407 | A | 9/1997 | Beckett | |
| 5,688,427 | A | 11/1997 | Gallo, Jr. | |
| 5,759,418 | A | 6/1998 | Frater et al. | |
| 5,759,422 | A | 6/1998 | Schmelzer | |
| 5,800,724 | A | 9/1998 | Habeger | |
| 5,948,308 | A * | 9/1999 | Wischusen, III | 219/730 |
| 6,114,679 | A | 9/2000 | Lal | |
| 6,150,646 | A | 11/2000 | Lal | |
| 6,204,492 | B1 | 3/2001 | Zeng | |
| 6,251,451 | B1 | 6/2001 | Zeng | |
| 6,359,272 | B1 * | 3/2002 | Sadek et al. | 219/732 |
| 6,414,290 | B1 | 7/2002 | Cole | |
| 6,433,322 | B2 | 8/2002 | Zeng | |
| 6,455,827 | B2 | 9/2002 | Zeng | |
| 6,552,315 | B2 | 4/2003 | Zeng | |
| 6,677,563 | B2 | 1/2004 | Lai | |
| 6,717,121 | B2 | 4/2004 | Zeng | |
| 6,765,182 | B2 | 7/2004 | Cole | |
| 6,960,748 | B2 * | 11/2005 | Baker | 219/725 |
| 2005/0230383 | A1 * | 10/2005 | Romeo et al. | 219/730 |
| 2006/0049190 | A1 | 3/2006 | Middleton | |
| 2007/0056962 | A1 * | 3/2007 | Hopkins et al. | 219/730 |
| 2007/0087090 | A1 | 4/2007 | Russell | |
| 2009/0218338 | A1 | 9/2009 | Fitzwater | |
| 2009/0230126 | A1 | 9/2009 | Fitzwater | |

FOREIGN PATENT DOCUMENTS

| | | | |
|---|---|---|---|
| EP | 0 503 302 | A2 | 9/1992 |
| FR | 745013 | | 5/1933 |
| FR | 943 904 | A | 3/1949 |
| FR | 961269 | | 5/1950 |
| GB | 925971 | | 5/1963 |
| GB | 2 127 677 | A | 4/1984 |
| GB | 2 150 534 | A | 7/1985 |
| WO | WO 93/19566 | | 9/1993 |
| WO | WO 2008/052096 | A1 | 5/2008 |
| WO | WO 2008/115272 | A2 | 9/2008 |

* cited by examiner

ELEVATED MICROWAVE HEATING CONSTRUCT

CROSS-REFERENCE TO RELATED APPLICATIONS

This application claims the benefit of U.S. Provisional Application No. 60/716,262, filed Sep. 12, 2005; U.S. Provisional Application No. 60/723,827, filed Oct. 5, 2005; U.S. Provisional Application No. 60/724,196, filed Oct. 6, 2005; and U.S. Provisional Application No. 60/736,442, filed Nov. 14, 2005, each of which is incorporated by reference hereby in its entirety.

TECHNICAL FIELD

The present invention relates to various blanks, constructs, and methods for heating, browning, and/or crisping a food item, and particularly relates to various blanks, constructs, and methods for heating, browning, and/or crisping a food item in a microwave oven.

BACKGROUND

Microwave ovens provide a convenient means for heating a variety of food items, including dough-based products such as pizzas and pies. However, microwave ovens tend to cook such items unevenly and are unable to achieve the desired balance of thorough heating and a browned, crisp crust. Thus, there is a continuing need for a microwavable package that provides the desired degree of heating, browning, and crisping of the crust or dough of a food item.

SUMMARY

The present invention is directed generally to various blanks, constructs formed from such blanks, and methods of making such blanks and constructs. The various constructs include one or more features that elevate a food-bearing platform from the turntable and/or the interior floor of the microwave oven. By elevating the food item in this manner, more heat is retained by and/or directed to the food item, rather than being lost to the turntable or the floor of the microwave oven. As a result, the microwave heating efficiency is improved significantly. The various constructs also may include one or more microwave energy interactive elements that further enhance the heating, browning, and/or crisping of a food item in a microwave oven.

In one aspect, the invention encompasses a blank for a construct, where the blank comprises a main panel and a pair of opposed leg portions extending from the main panel along respective first fold lines. Each first fold line is interrupted by a receiving slot. Each leg portion terminates with a locking feature dimensioned to be received within the respective receiving slot. In one variation of this aspect, each leg portion comprises a plurality of panels joined along fold lines. For example, each leg portion may comprise a first panel joined to the main panel along the first fold line, a second panel joined to the first panel along a second fold line, and a third panel joined to the second panel along a third fold line, with the locking feature extending from the third panel. Various locking features are contemplated hereby. For example, the locking feature may be a tab that is somewhat arrow shaped. A microwave energy interactive element may overlie and/or be joined to at least a portion of the main panel.

Various constructs may be formed from the blank by folding each leg portion along the respective first fold line and inserting each locking feature into the respective receiving slot to form a pair of legs. In one example, the construct includes a platform for receiving a food item thereon, the platform being defined at least partially by the main panel, a pair of legs formed from the folded leg portions, and a microwave energy interactive element overlying and at least partially joined to the platform.

In another aspect, the invention encompasses a blank for a construct, where the blank comprises a pair of opposed leg portions joined to a main panel. Each leg portion includes a first panel joined to the main panel along a first fold line, a second panel joined to the first panel along a second fold line, and a third panel joined to the second panel along a third fold line. In one variation, the blank also includes a fourth panel joined to the main panel along a fourth fold line. If desired, a microwave energy interactive element may overlie at least a portion of the main panel. A construct generally may be formed from the blank by folding the opposed leg portions toward a first side of the main panel along each respective first fold line, and folding the second panel and the third panel of each leg portion along respective fold lines to form a pair of legs. Various constructs may be formed from the blank.

In one variation of this aspect, the blank further comprises a pair of substantially opposed handle panels extending from the main panel along respective fold lines, where each fold line is interrupted by a cut line. In this variation, a construct may be formed from the blank by folding the opposed leg portions toward a first side of the main panel along each respective first fold line, folding the second panel and the third panel of each leg portion along respective fold lines to form a pair of legs, and folding the opposed handle panels toward a second side of the main panel to form a pair of substantially opposed handles.

In still another aspect, the invention encompasses a blank for a construct, where the blank comprises a pair of substantially opposed leg portions joined to a main panel along respective fold lines. The main panel includes a plurality of apertures extending therethrough. Each leg portion includes a central panel having a length substantially equal to that of the respective fold line. Each leg portion also includes a first end panel and a second end panel hingedly joined to opposed ends of the central panel. The first end panel and the second end panel each include a locking feature proximate to the main panel. At least one of the locking features is dimensioned to be received within at least one of the plurality of apertures. Each locking feature may comprise a substantially rectangular protrusion extending from an interior edge of each of the first end panels and second end panels or may have any other suitable shape. If desired, a microwave energy interactive element may overlie at least a portion of the main panel.

In one variation of this aspect, the first end panel and the second end panel are joined hingedly to opposed ends of the central panel along respective end panel fold lines, and the plurality of apertures includes at least one aperture substantially aligned with and between the respective first and second end panel fold lines of the opposed leg portions. In another variation of this aspect, the first end panel and the second end panel are joined hingedly to opposed ends of the central panel along respective end panel fold lines, and the plurality of apertures includes at least one aperture offset from the respective first end panel fold lines of the opposed leg portions.

In yet another aspect, the invention encompasses a blank for a construct, where the blank comprises a first leg portion and a second leg portion, each extending from a main panel along a respective fold line. The first leg portion and the second leg portion each include a central panel having a length substantially equal to that of the respective fold line. A first end panel and a second end panel is joined hingedly to opposed ends of the central panel. The first end panel and the second panel each include a locking feature comprising a notch. The notches in the first leg portion extend to an interior edge of the first leg portion proximate the main panel and the notches in the second leg portion extend to an exterior edge of the second leg portion distal the main panel. The notches in the first end panel of each of the first leg portion and the second leg portion are substantially aligned and the notches in the second end panel of each of the first leg portion and the second leg portion are substantially aligned. The notches may have any suitable shape, and in one example, at least one of the notches may comprise a substantially triangular slit. A microwave energy interactive element may overlie at least a portion of the main panel.

A construct may be formed from the blank by folding the first leg portion and the second leg portion toward a surface opposed to a food-contacting surface of the main panel, such that each of the first leg portion and the second leg portion are substantially perpendicular to the main panel, folding the first end panel and the second end panel of each of the first leg portion and the second leg portion inwardly toward one another, such that each of the first leg panels and the second leg panels extend obliquely from the respective center panel, interlocking the notches in the first end panel of the first leg portion and the second leg portion, and interlocking the notches in the second end panel of each of the first leg portion and the second leg portion.

In one variation of this aspect, the blank may include a pair of substantially opposed handle panels extending from the main panel along respective fold lines, where each handle panel includes an elongate aperture. Each handle panel have a substantially arcuate exterior edge. A construct may be formed from the blank by folding the first leg portion and the second leg portion toward a surface opposed to a food-contacting surface of the main panel, such that each of the first leg portion and the second leg portion are substantially perpendicular to the main panel, folding the first end panel and the second end panel of each of the first leg portion and the second leg portion inwardly toward one another, such that each of the first leg panels and the second leg panels extend obliquely from the respective center panel, interlocking the notches in the first end panel of the first leg portion and the second leg portion, interlocking the notches in the second end panel of each of the first leg portion and the second leg portion, and folding the opposed handle panels toward the food-contacting surface to form a pair of substantially opposed handles.

In another variation of this aspect, the blank further comprises a pair of substantially opposed end panels joined to the main panel along respective fold lines. Each end panel includes a center panel and a pair of substantially opposed bias cut side panels. The main panel includes a receiving slot adjacent to each of the bias cut side panels. Each receiving slot is dimensioned to receive at least a portion of the adjacent bias cut end panel. A construct may be formed from the blank by folding the first leg portion and the second leg portion toward a surface opposed to a food-contacting surface of the main panel, such that each of the first leg portion and the second leg portion are substantially perpendicular to the main panel, folding the first end panel and the second end panel of each of the first leg portion and the second leg portion toward one another, such that each of the first end panel and the second end panel form acute angles relative to the respective center panel, interlocking the notches in the first end panel of the first leg portion and the second leg portion, interlocking the notches in the second end panel of each of the first leg portion and the second leg portion, folding the end panels toward the surface opposed to the food-contacting surface along their respective fold lines, and inserting at least a portion of each of the bias cut side panels into the respective receiving slot.

In still another aspect, the invention encompasses a blank for a construct, where the blank comprises a first leg portion and a second leg portion joined to a main panel. The first leg portion includes a plurality of panels joined along fold lines and a tab extending from an edge of the first leg portion distal the main panel. The second leg portion includes a plurality of panels joined along fold lines and a receiving slot dimensioned to receive the tab extending from the first leg portion.

In one example, the plurality of panels of the first leg portion include a connection portion extending from the main panel, a first panel joined to the connection portion along a first fold line, and a second panel joined to the first panel along a second fold line. In another example, the plurality of panels of the second leg portion include a connection portion extending from the main panel, a first panel joined to the connection portion along a first fold line, a second panel joined to the first panel along a second fold line, a third panel joined to the second panel along a third fold line, a fourth panel joined to the third panel along a fourth fold line, and a fifth panel joined to the fourth panel along a fifth fold line. The third fold line may be interrupted by the receiving slot.

A microwave energy interactive element, for example, a susceptor film, may overlie and/or be joined to at least a portion of the main panel. The periphery of the microwave energy interactive element may define a boundary between the connection portion and the main panel.

In yet another aspect, the invention contemplates a tray for supporting a food item at an elevated position. The tray comprises a platform including a first surface for supporting the food item and at least one support element extending from a peripheral edge of the platform. The support element includes a plurality of minor panels joined along fold lines. At least one of the minor panels is disposed at least partially below the platform. In one variation, the tray has a length that extends in a lengthwise direction, the platform has a length that extends in the lengthwise direction, the support element has a length that extends in the lengthwise direction, and the length of the platform is greater than the length of the support element. The tray may include a pair of substantially opposed, substantially upwardly extending handles joined to the platform. If desired, a microwave energy interactive element may overlie at least a portion of the platform.

In one variation, the plurality of minor panels includes a first minor panel extending downwardly from the peripheral edge of the platform and a second minor panel foldably joined to the first minor panel. The second minor panel may form an acute angle with respect to the first minor panel, may form an obtuse angle with respect to the first minor panel, or may form a right angle with respect to the first minor panel.

In another variation, at least a portion of the second minor panel lies beneath the platform. At least some of the minor panels of the support element may define a substantially triangular shape or other polygonal shape in an elevational view of the support element. At least a portion of the second minor panel may extend upwardly through an opening in the platform.

If desired, the support element may include a locking feature extending from at least one of the minor panels. The support element may be locked releasably to the main panel by way of interaction between the locking feature and an opening in the main panel.

In another variation, the support element is a first support element, the tray comprises a second support element a peripheral edge of the platform, the second support element includes a plurality of minor panels joined along fold lines, and at least one of the minor panels of the second support element is disposed at least partially below the platform. The first support element and the second support element may cooperate with one another to maintain the first support element and the second support element in a locked configuration. In one example, the first support element includes a tab, the second support element includes a receiving slot dimensioned to receive the tab, and the tab cooperates with the receiving slot to maintain the first support element and the second support element in a locked configuration. In another example, the first support element and the second support element each include a notch, and the notches cooperate with one another to maintain the first support element and the second support element in a locked configuration.

Other features, aspects, and embodiments will be apparent from the following description and accompanying figures.

BRIEF DESCRIPTION OF THE DRAWINGS

The description refers to the accompanying drawings, some of which are schematic, in which like reference characters refer to like parts throughout the several views, and in which.

DESCRIPTION

The present invention may be illustrated further by referring to the figures. For simplicity, like numerals may be used to describe like features. It will be understood that where a plurality of similar features are depicted, not all of such features necessarily are labeled on each figure. It also will be understood that various components used to form the blanks and constructs of the present invention may be interchanged. Thus, while only certain combinations are illustrated herein, numerous other combinations and configurations are contemplated hereby.

Figure 1A:
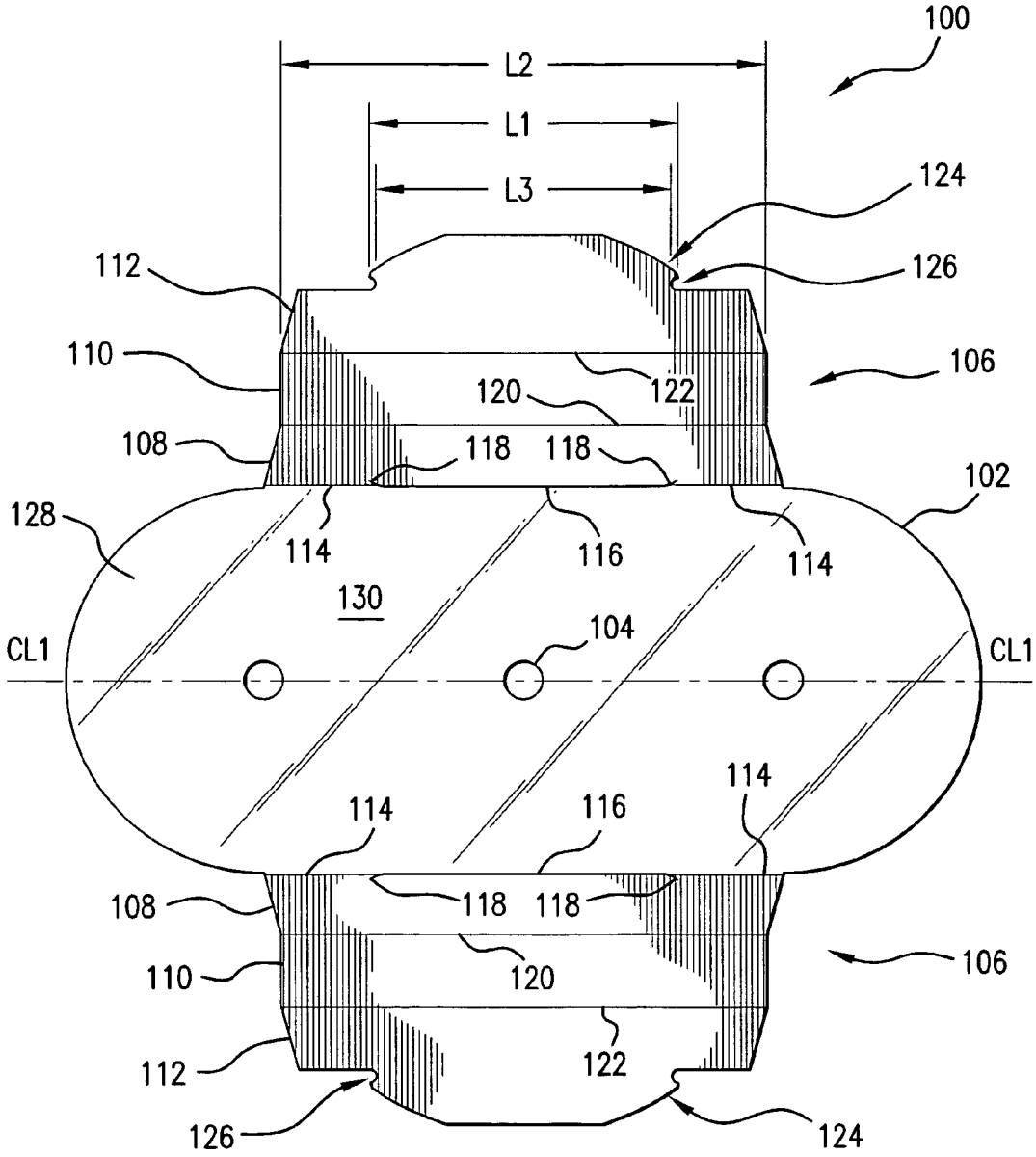
FIG. 1A depicts an exemplary blank according to various aspects of the invention.
Figure 1B:
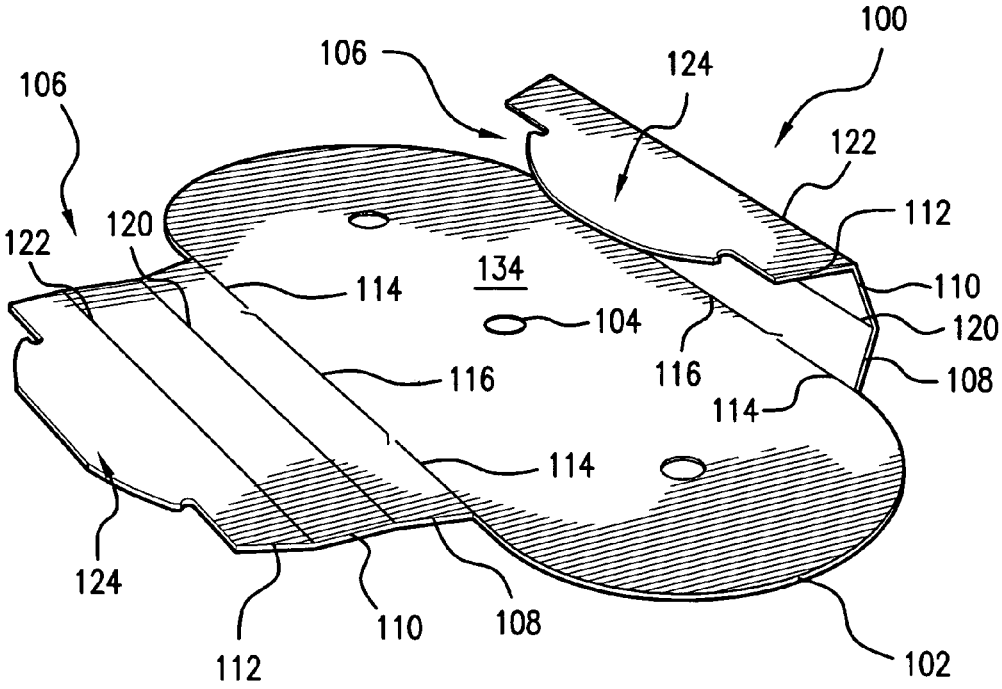
FIGS. 1B-1D depict the blank of FIG. 1 being formed into an exemplary construct for heating, browning, and/or crisping a food item, according to various aspects of the invention.

FIG. 1A depicts an exemplary blank 100 according to various aspects of the present invention. The blank 100 may be symmetric or nearly symmetric about a transverse center line CL1. Therefore, certain elements in the drawing figures may have similar or identical reference numerals to reflect the whole or partial symmetry.

The blank 100 includes a generally obround food-bearing panel or main panel 102 suitable, for example, for heating a French bread pizza or sandwich thereon. However, in this and other aspects of the invention, it will be understood that numerous suitable shapes and configurations may be used to form the main panel. Examples of other shapes encompassed hereby include, but are not limited to, polygons, circles, ovals, or any other regular or irregular shape. The shape of the main panel may be determined by the shape of the food item, and it should be understood that different packages are contemplated for different food items, for example, sandwiches, pizzas, French fries, soft pretzels, pizza bites, cheese sticks, pastries, doughs, and so forth. The main panel may be sized and shaped to receive one portion or multiple portions of one or more different food items.

As shown in FIG. 1A, the main panel 102 includes a plurality of spaced apertures 104. In this example, the main panel 102 includes three apertures 104 positioned substantially along the transverse axis or centerline CL1 of the main panel 102, each aperture 104 being substantially circular in shape. However, it will be understood that the number, shape, spacing, and positioning of the apertures may vary depending on the food item to be heated and the desired degree of browning and crisping, as will be discussed further below.

The blank 100 includes a pair of substantially opposed support element portions or leg portions 106 extending from a peripheral edge of the main panel 102. Each leg portion 106 includes a plurality of minor panels joined by fold lines. In this example, each leg portion 106 is formed from a first panel 108, a second panel 110, and a third panel 112. The first panel 108 is joined to the main panel 102 along fold line 114, which is interrupted by an opening, for example, a receiving slot 116 having oblique end portions 118. The second panel 110 is joined to the first panel 108 along fold line 120. The third panel 112 is joined to the second panel 110 along fold line 122. The third panel 112 includes a somewhat trapezoidal or arrow shaped locking feature or tab 124 at least partially defined by a narrowed section or throat 126. The tab 124 may be narrower in length than the third panel 112, as indicated by respective lengths L1 and L2 (measured at widest point). Likewise, the throat 126 is narrower in dimension than the tab 124 measured at the widest point, as indicated by L3.

Numerous materials may be suitable for use in forming the various blanks and constructs of the invention, provided that the materials are resistant to softening, scorching, combusting, or degrading at typical microwave oven heating temperatures, for example, at from about 250° F. to about 425° F. The particular materials used may include microwave energy interactive materials and microwave energy transparent or inactive materials.

For example, any of the various blanks or constructs of the present invention may include one or more features that alter the effect of microwave energy during the heating or cooking of the food item. For example, the blank or construct may be formed at least partially from one or more microwave energy interactive elements (hereinafter sometimes referred to as "microwave interactive elements") that promote browning and/or crisping of a particular area of the food item, shield a particular area of the food item from microwave energy to prevent overcooking thereof, or transmit microwave energy toward or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular microwave heating construct and food item.

The microwave interactive element may be supported on a microwave inactive or transparent substrate for ease of handling and/or to prevent contact between the microwave interactive material and the food item. As a matter of convenience and not limitation, and although it is understood that a microwave interactive element supported on a microwave transparent substrate includes both microwave interactive and microwave inactive elements or components, such constructs are referred to herein as "microwave interactive webs".

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymer film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In one example, the microwave interactive element may comprise a thin layer of microwave interactive material, for example, a susceptor, that tends to absorb microwave energy and generate heat at the interface with a food item in intimate or proximate contact therewith. Such elements often are used to promote browning and/or crisping of the surface of a food item (sometimes referred to as a "browning and/or crisping element"). When supported on a film or other substrate, such an element may be referred to as a "susceptor film" or, simply, "susceptor". In the example illustrated in FIG. 1A, the blank 100 includes a susceptor film 128 substantially overlying and joined to at least a portion of the main panel 102 to form at least a portion of a first surface 130, which may serve as a food-contacting or food-bearing surface. However, other microwave energy interactive elements, such as those described herein, are contemplated for use with the invention.

For example, the microwave interactive element may comprise a foil having a thickness sufficient to shield one or more selected portions of the food item from microwave energy (sometimes referred to as a "shielding element"). Such shielding elements may be used where the food item is prone to scorching or drying out during heating. The shielding element may be formed from various materials and may have various configurations, depending on the particular application for which the shielding element is used. Typically, the shielding element is formed from a conductive, reflective metal or metal alloy, for example, aluminum, copper, or stainless steel. The shielding element generally may have a thickness of from about 0.000285 inches to about 0.05 inches. In one aspect, the shielding element has a thickness of from about 0.0003 inches to about 0.03 inches. In another aspect, the shielding element has a thickness of from about 0.00035 inches to about 0.020 inches, for example, 0.016 inches.

As still another example, the microwave interactive element may comprise a segmented foil, such as, but not limited to, those described in U.S. Pat. Nos. 6,204,492, 6,433,322, 6,552,315, and 6,677,563, each of which is incorporated by reference in its entirety. Although segmented foils are not continuous, appropriately spaced groupings of such segments often act as a transmitting element to direct microwave energy to specific areas of the food item. Such foils also may be used in combination with browning and/or crisping elements, for example, susceptors.

Any of the numerous microwave interactive elements described herein or contemplated hereby may be substantially continuous, that is, without substantial breaks or interruptions, or may be discontinuous, for example, by including one or more breaks or apertures that transmit microwave energy therethrough. The breaks or apertures may be sized and/or positioned to heat particular areas of the food item selectively. The number, shape, size, and positioning of such breaks or apertures may vary for a particular application depending on type of construct being formed, the food item to be heated therein or thereon, the desired degree of shielding, browning, and/or crisping, whether direct exposure to microwave energy is needed or desired to attain uniform heating of the food item, the need for regulating the change in temperature of the food item through direct heating, whether and to what extent there is a need for venting, and numerous other factors.

It will be understood that the aperture may be a physical aperture or void in the material used to form the construct, or may be a non-physical "aperture". A non-physical aperture may be a portion of the construct that is microwave energy inactive by deactivation or otherwise, or one that is otherwise transparent to microwave energy. Thus, for example, the aperture may be a portion of the construct formed without a microwave energy active material or, alternatively, may be a portion of the construct formed with a microwave energy active material that has been deactivated. While both physical and non-physical apertures allow the food item to be heated directly by the microwave energy, a physical aperture also provides a venting function to allow steam or other vapors to be released from the food item.

As stated above, any of the above elements and numerous others contemplated hereby may be supported on a substrate. The substrate typically comprises an electrical insulator, for example, a polymer film or other polymeric material. As used herein the terms "polymer", "polymer film", and "polymeric material" include, but are not limited to, homopolymers, copolymers, such as for example, block, graft, random, and alternating copolymers, terpolymers, etc. and blends and modifications thereof. Furthermore, unless otherwise specifically limited, the terms "polymer", "polymer film", and "polymeric material" shall include all possible geometrical configurations of the molecule. These configurations include, but are not limited to isotactic, syndiotactic, and random symmetries.

The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymer films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one example, the polymer film comprises polyethylene terephthalate (PET). Polyethylene terephthalate films are used in commercially available susceptors, for example, the QWIKWAVE® Focus susceptor and the MICRORITE® susceptor, both available from Graphic Packaging International (Marietta, Ga.). Examples of polyethylene terephthalate films that may be suitable for use as the substrate include, but are not limited to, MELINEX®, commercially available from DuPont Teijan Films (Hopewell, Va.), SKYROL, commercially available from SKC, Inc. (Covington, Ga.), and BARRIALOX PET, available from Toray Films (Front Royal, Va.), and QU50 High Barrier Coated PET, available from Toray Films (Front Royal, Va.).

The polymer film may be selected to impart various properties to the microwave interactive web, for example, printability, heat resistance, or any other property. As one particular example, the polymer film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.). Additional examples include BARRIALOX PET, available from Toray Films (Front Royal, Va.) and QU50 High Barrier Coated PET, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 $cc/m^2/day$. In one aspect, the barrier film has an OTR of less than about 10 $cc/m^2/day$. In another aspect, the barrier film has an OTR of less than about 1 $cc/m^2/day$. In still another aspect, the barrier film has an OTR of less than about 0.5 $cc/m^2/day$. In yet another aspect, the barrier film has an OTR of less than about 0.1 $cc/m^2/day$.

The barrier film may have a water vapor transmission rate (WVTR) of less than about 100 $g/m^2/day$ as measured using ASTM F1249. In one aspect, the barrier film has a WVTR of less than about 50 $g/m^2/day$. In another aspect, the barrier film has a WVTR of less than about 15 $g/m^2/day$. In yet another aspect, the barrier film has a WVTR of less than about 1 $g/m^2/day$. In still another aspect, the barrier film has a WVTR of less than about 0.1 $g/m^2/day$. In a still further aspect, the barrier film has a WVTR of less than about 0.05 $g/m^2/day$.

Other non-conducting substrate materials such as metal oxides, silicates, cellulosics, or any combination thereof, also may be used in accordance with the present invention.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item. For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,410,290; 6,251,451; 6,204,492; 6,150,646; 6,114,679; 5,800,724; 5,759,418; 5,672,407; 5,628,921; 5,519,195; 5,420,517; 5,410,135; 5,354,973; 5,340,436; 5,266,386; 5,260,537; 5,221,419; 5,213,902; 5,117,078; 5,039,364; 4,963,420; 4,936,935; 4,890,439; 4,775,771; 4,865,921; and Re. 34,683, each of which is incorporated by reference herein in its entirety. Although particular examples of patterns of microwave energy interactive material are shown and described herein, it should be understood that other patterns of microwave energy interactive material are contemplated by the present invention.

If desired, the microwave interactive element or microwave interactive web may be joined to or overlie a dimensionally stable, microwave energy transparent support (hereinafter referred to as "microwave transparent support", "microwave inactive support" or "support") to form at least a portion of the construct.

In one aspect, for example, where a rigid or semi-rigid construct is to be formed, all or a portion of the support may be formed at least partially from a paperboard material, which may be cut into a blank prior to use in the construct. For example, the support may be formed from paperboard having a basis weight of from about 60 to about 330 lbs/ream, for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International.

In another aspect, where a more flexible construct is to be formed, the support may comprise a paper or paper-based material generally having a basis weight of from about 15 to about 60 lbs/ream, for example, from about 20 to about 40 lbs/ream. In one particular example, the paper has a basis weight of about 25 lbs/ream.

Optionally, one or more portions or sides of the various blanks or other constructs described herein or contemplated hereby may be coated with varnish, clay, or other materials, either alone or in combination. For example, at least the side of the support that will form an exterior surface of a construct erected therefrom may be coated with a clay coating or other base coating. The coating may then be printed over with product advertising, images, price coding, any other information or indicia, or any combination thereof. The blank or construct may then may be overcoated with a varnish to protect any information printed thereon.

Furthermore, the blanks or other constructs may be coated with, for example, a moisture and/or oxygen barrier layer, on either or both sides, such as those described above. Any suitable moisture and/or oxygen barrier material may be used in accordance with the present invention. Examples of materials that may be suitable include, but are not limited to, polyvinylidene chloride, ethylene vinyl alcohol, DuPont DARTEK™ nylon 6,6, and others referred to above.

Alternatively or additionally, any of the blanks or other constructs of the present invention may be coated or laminated with other materials to impart other properties, such as absorbency, repellency, opacity, color, printability, stiffness, or cushioning. For example, absorbent susceptors are described in U.S. Patent Application Publication No. 2006/0049190A1, published Mar. 9, 2006, which is incorporated herein by reference in its entirety.

It will be understood that with some combinations of elements and materials, the microwave interactive element may have a grey or silver color this is visually distinguishable from the substrate or the support. However, in some instances, it may be desirable to provide a web or construct having a uniform color and/or appearance. Such a web or construct may be more aesthetically pleasing to a consumer, particularly when the consumer is accustomed to packages or containers having certain visual attributes, for example, a solid color, a particular pattern, and so on. Thus, for example, the present invention contemplates using a silver or grey toned adhesive to join the microwave interactive elements to the substrate, using a silver or grey toned substrate to mask the presence of the silver or grey toned microwave interactive element, using a dark toned substrate, for example, a black toned substrate, to conceal the presence of the silver or grey toned microwave interactive element, overprinting the metallized side of the web with a silver or grey toned ink to obscure the color variation, printing the non-metallized side of the web with a silver or grey ink or other concealing color in a suitable pattern or as a solid color layer to mask or conceal the presence of the microwave interactive element, or any other suitable technique or combination thereof.

Figure 1C:
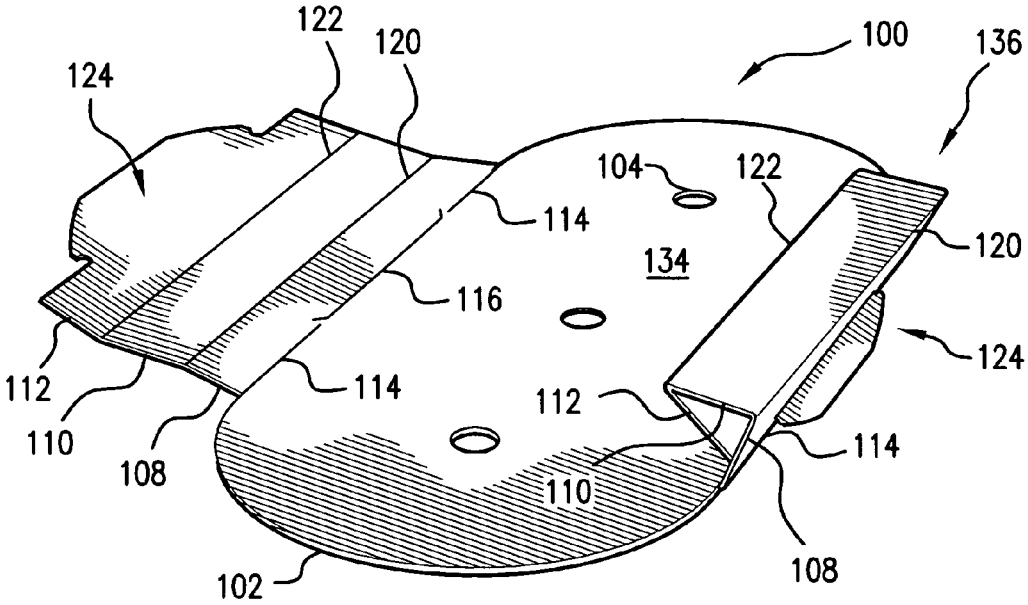
Figure 1D:
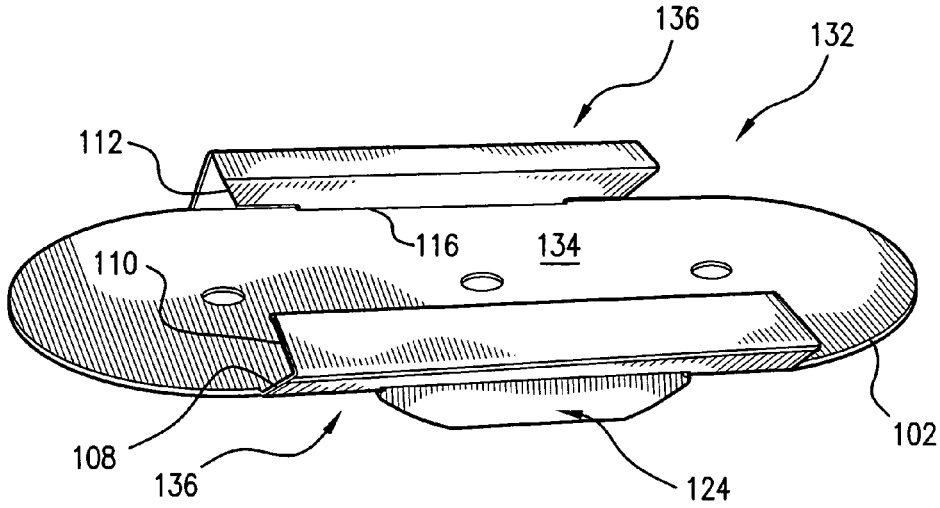
Figure 1E:
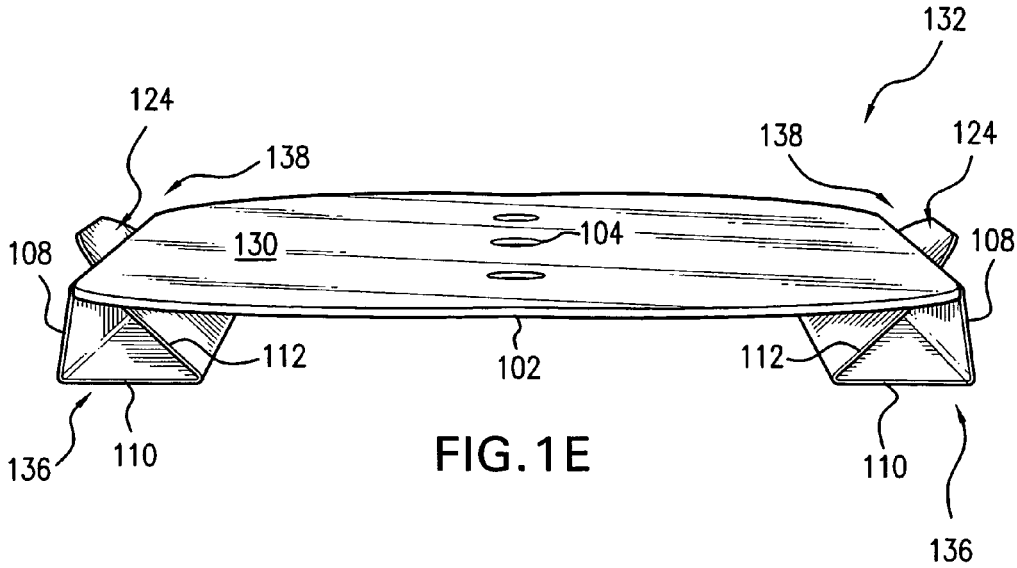
FIGS. 1E and 1F depict an exemplary construct formed from the blank of FIG. 1A, according to various aspects of the invention.
Figure 1F:
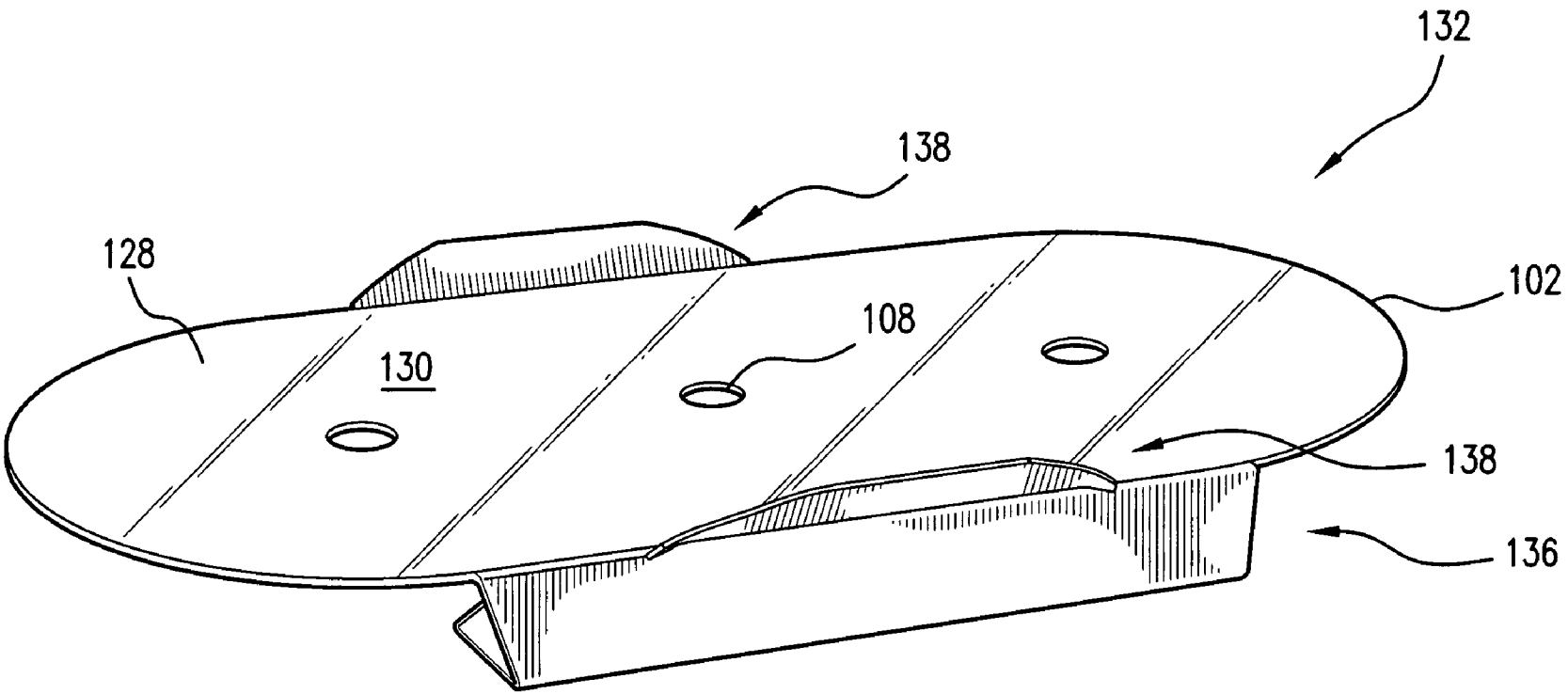

Turning to FIGS. 1B-1E, to form the blank 100 into a construct, for example, a tray 132, one of the tabs 124 may be brought toward the bottom surface 134 of the main panel 102 and inserted into the respective proximate receiving slot 116. In doing so, the various panels 108, 110, 112 may be folded along fold lines 114, 120, 122, thereby forming a somewhat triangular shaped support element or leg 136 that lies partially beneath and serves to support the food-bearing panel or platform 102 (FIG. 1C). This process may be repeated (not shown) for the other leg portion 106 to form a second support element or leg 136 secured within the respective receiving slot 116 (FIG. 1D). As shown in FIGS. 1E and 1F, in which the tray 132 has been inverted and placed in an upright configuration, the tabs 124 extend through respective receiving slots 116 to form a pair of upwardly extending handles 138 that may be used to grasp the tray 132.

Alternatively, to assemble the tray 132, the first panel 108 may be folded along fold line 114 in a direction away from the food-contacting surface 130 so that the first panel 108 is somewhat perpendicular to the platform 102. A first leg 136 then may be formed by folding the second panel 110 past the first panel 108 along fold lines 120 and 122 such that the second panel 110 is substantially parallel with the platform 102. At this point, the tab 124 is superposed with the platform 102. Next, the third panel 112 may be folded toward the platform 102 and the tab 124 is inserted through the receiving slot 116, thereby forming somewhat triangular shaped support elements or legs 136 that support the food-bearing panel or platform 102. In particular, each leg 136 respectively includes somewhat vertical and oblique supporting panels 108 and 112 and a horizontal supporting panel 110. The tabs 124 extend through receiving slots 116 to form handles 138 that may be used to grasp the tray 132.

In this and other aspects of the invention, it will be understood that while various methods of forming a tray are provided herein, other methods are contemplated hereby. The method used may depend on various factors, including the shape of the platform, and so forth. Additionally, in the example described in detail herein, the legs are somewhat triangular in shape. However, it will be understood that the leg portions and each of the various components thereof may have any suitable shape and dimensions depending on the size and weight of the food item, the resulting size of the platform 102, the desired degree of stability in the construct formed from the blank 100, and numerous other factors. For example, the legs may have a somewhat square shape by including an additional panel. A still additional panel may result in legs having a pentagonal shape. Other shapes are contemplated hereby.

Viewing FIGS. 1E and 1F, to use the tray 132, a food item (not shown) is placed on the food-bearing surface 130 of the platform 102 and placed in a microwave oven (not shown). The support elements or legs 136 support the platform 102 and maintain the food item at an elevated position in the microwave oven (not shown). The apertures 104 provide venting of steam that is generated during heating, thereby improving browning and/or crisping of the food item. Additionally, the air between the platform 102 and the floor of the microwave oven provides an insulating effect, thereby decreasing the amount of heat loss from the microwave energy interactive material to the floor of the microwave oven, particularly where a susceptor 128 is used.

Figure 2A:
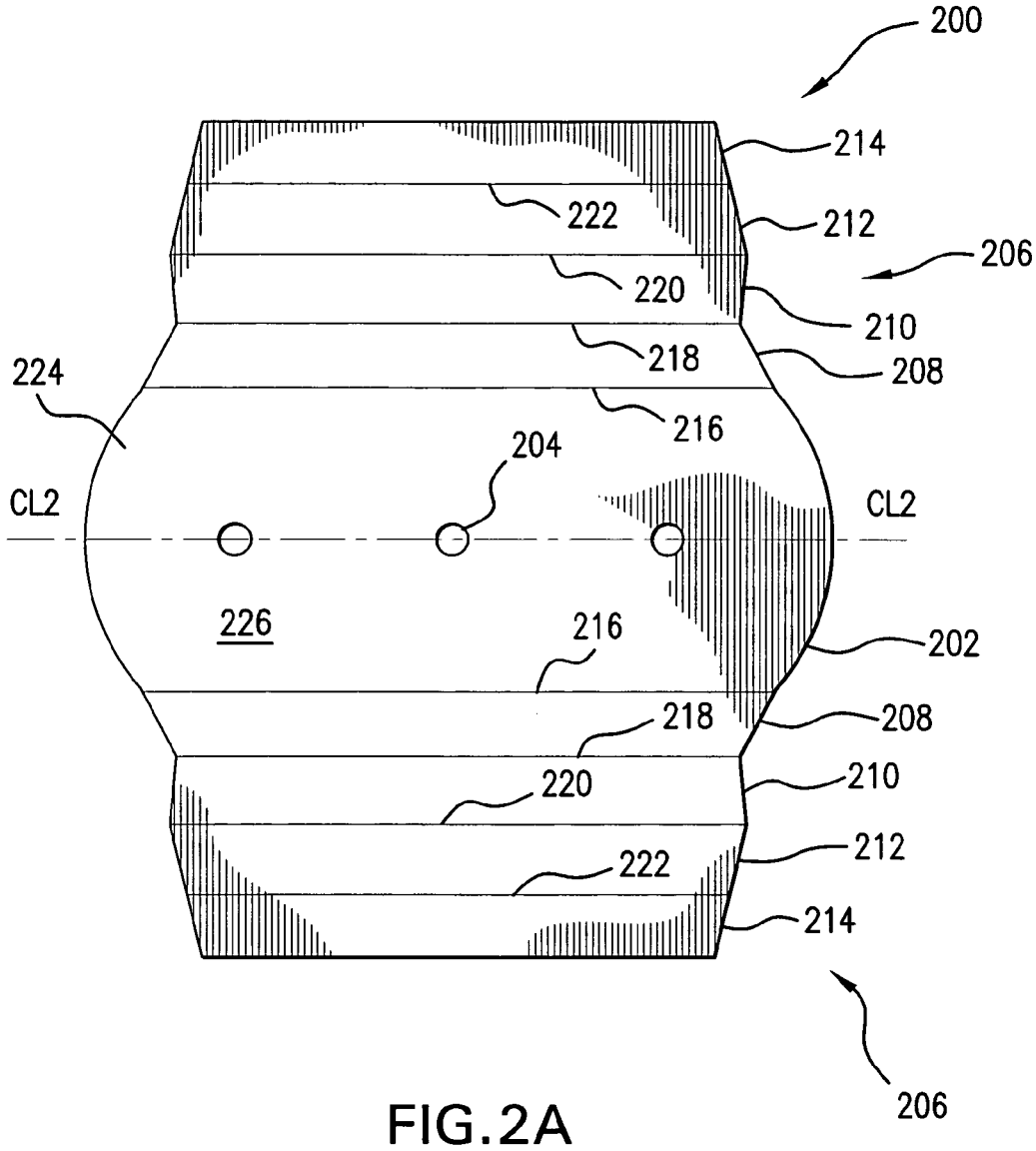
FIG. 2A depicts another exemplary blank according to various aspects of the invention.

FIG. 2A illustrates another exemplary blank 200 that may be used in accordance with various aspects of the invention. The blank 200 may be symmetric or nearly symmetric about a transverse center line CL2. Therefore, certain elements in the drawing figures may have similar or identical reference numerals to reflect the whole or partial symmetry.

The blank 200 includes a generally obround food-bearing panel or main panel 202 having an elongate central portion and rounded end portions suitable, for example, for heating a French bread pizza or open-faced sandwich thereon. However, it will be understood that in this and other aspects of the invention described herein or contemplated hereby, numerous suitable shapes and configurations may be used in accordance with the invention.

Still viewing FIG. 2A, the main panel 202 also includes a plurality of spaced apertures 204. In this example, the main panel 202 includes three apertures 204 positioned substantially along a transverse axis or centerline CL2 of the main panel 202, each aperture 204 being substantially circular in shape and extending through the thickness of the main panel 202. However, it will be understood that in this and other aspects of the present invention, the number, shape, spacing, and positioning of the apertures may vary depending on the food item to be heated and the desired degree of browning and crisping.

The blank 200 includes a pair of substantially opposed support element portions or leg portions 206 extending from the main panel 202. Each leg portion 206 includes a plurality of minor panels joined by fold lines. In this example, each leg portion 206 is formed from a first panel 208, a second panel 210, a third panel 212, and a fourth panel 214. The first panel 208 is joined to the main panel 202 along fold line 216. The second panel 210 is joined to the first panel 208 along fold line 218. The third panel 212 is joined to the second panel 210 along fold line 220. The fourth panel 214 is joined to the third panel 212 along fold line 222. If desired, a microwave energy interactive element, for example, a susceptor 224, may overlie and be joined to at least a portion of the main panel 202, thereby at least partially defining a food contacting surface 226.

Figure 2B:
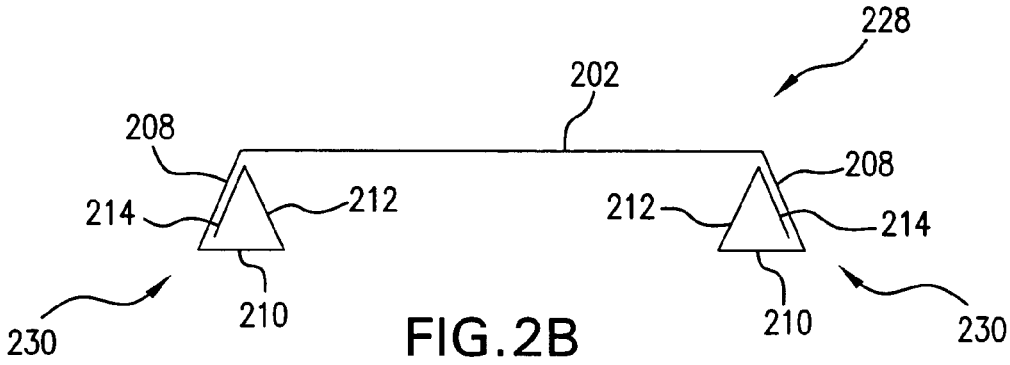
FIG. 2B schematically depicts an elevational view of the blank of FIG. 2A formed into an exemplary construct.
Figure 2C:
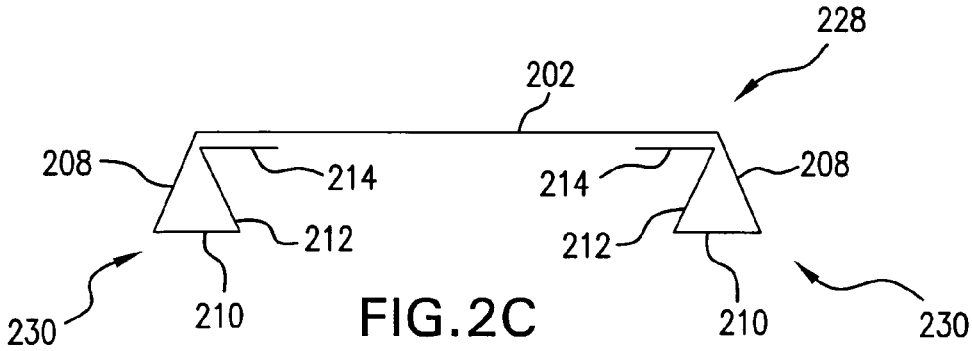
FIG. 2C schematically depicts an elevational view of the blank of FIG. 2A formed into another exemplary construct, according to various aspects of the invention.
Figure 2D:
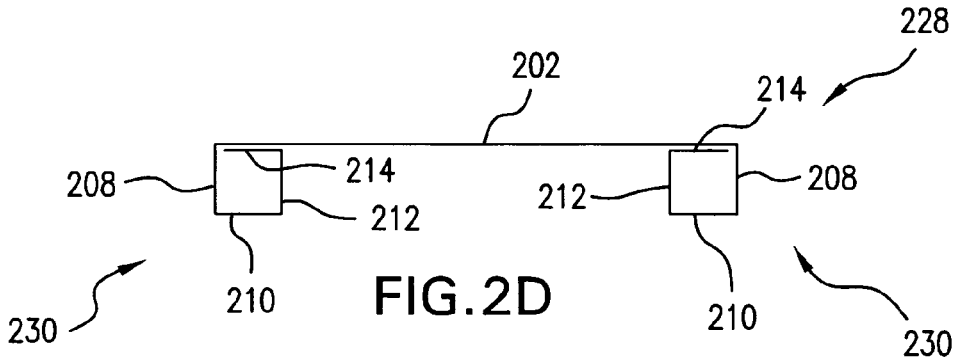
FIG. 2D schematically depicts an elevational view of the blank of FIG. 2A formed into yet another exemplary construct, according to various aspects of the invention.
Figure 2E:
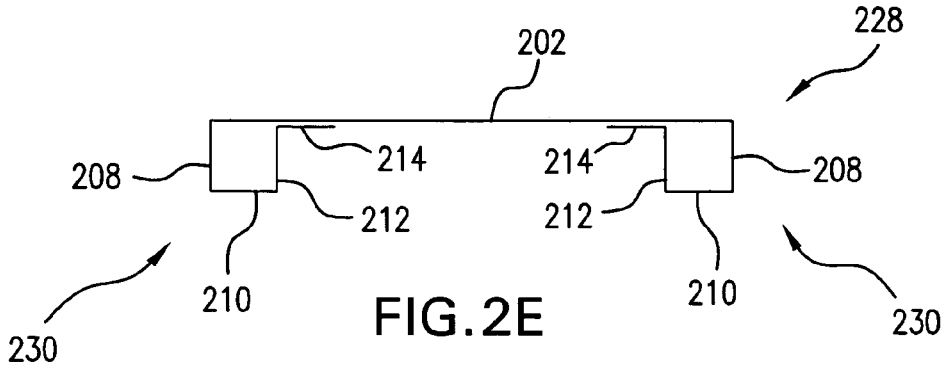
FIG. 2E schematically depicts an elevational view of the blank of FIG. 2A formed into still another exemplary construct, according to various aspects of the invention.

To assemble the blank 200 into a construct, for example, a tray 228 (shown in schematic elevational view in FIGS. 2B-2E), the various minor panels 208, 210, 212, 214 of each leg portion 206 generally may be folded along respective fold lines 216, 218, 220, 222, such that the various panels 208, 210, 212, 214 cooperate to form a leg 230 having one or more vertical and/or horizontal support components or leg components. The legs 230 may have various shapes, as shown in FIGS. 2B-2E. For example the leg 230 of FIG. 2B is somewhat triangular in shape, with the fourth panel 214 serving as a somewhat vertical or oblique support for the platform 202. In FIG. 2C, the leg 230 is somewhat triangular in shape, with the fourth panel 214 serving as a somewhat horizontal support panel substantially parallel to the platform 202. In FIG. 2D, the leg 230 is somewhat square in shape, with the fourth panel 214 serving as a somewhat horizontal support panel directed toward the other panels that form the leg 230. In FIG. 2E, the leg 230 is somewhat square in shape, with the fourth panel 214 serving as a somewhat horizontal support panel substantially parallel to the platform 202. While various leg configurations are shown herein, it will be understood that numerous other leg configurations are contemplated hereby. Thus, for example, fewer or more panels may be provided to make a triangular shape, square shape, pentagonal shape, hexagonal shape, and so forth.

In use, a food item (not shown) is placed on the food bearing surface 226 of the tray 228 and placed in a microwave oven (not shown). Legs 230 support the platform 202 and maintain the food item at an elevated position in the microwave oven. In this and other aspects of the present invention, the air between the platform 202 and the floor of the microwave oven provides an insulating effect, which decreases the heat loss to the microwave oven. Additionally, the apertures 204 tend to provide venting of steam that is generated during heating, thereby improving browning and/or crisping of the food item.

Figure 3A:
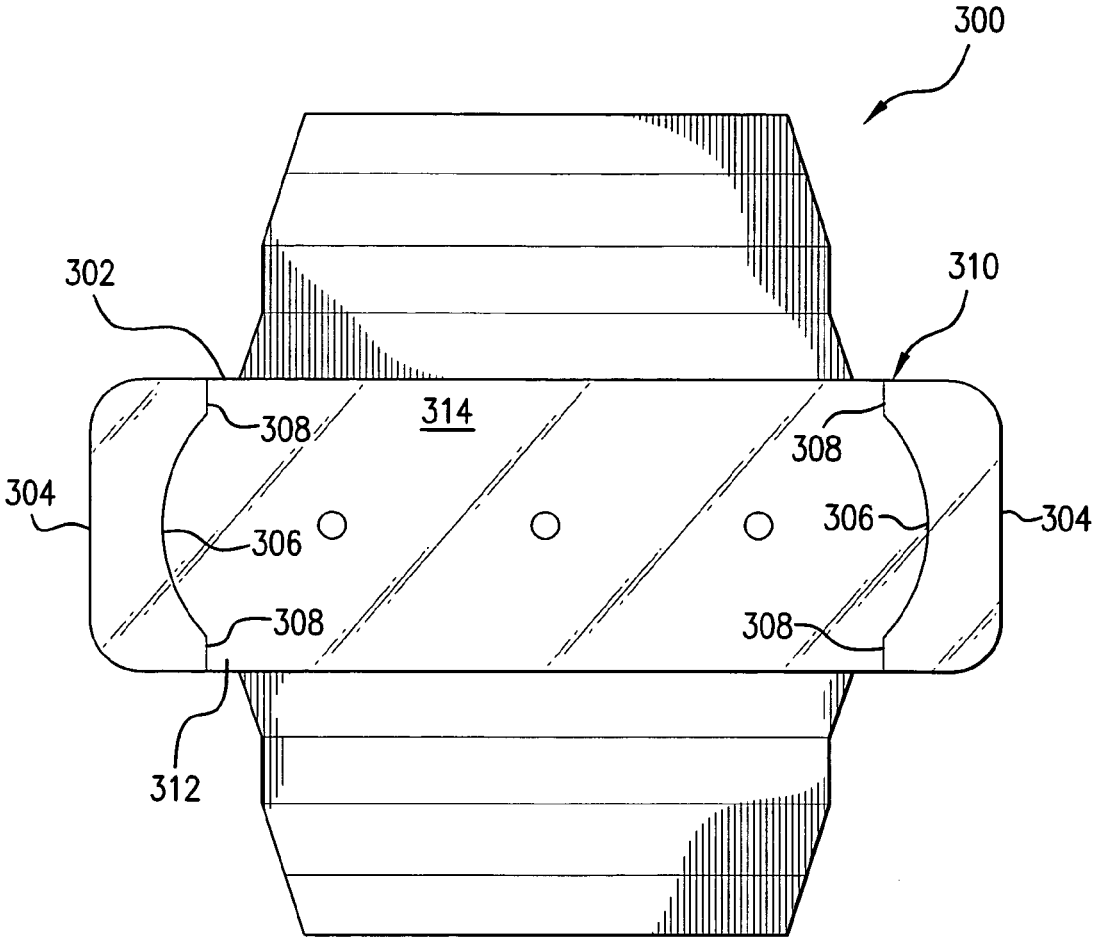
FIG. 3A depicts yet another exemplary blank according to various aspects of the invention.

FIG. 3A depicts another exemplary blank 300 in accordance with various aspects of the invention. The blank 300 includes some features that are similar to those described in connection with the blank 200 of FIG. 2A and, for purposes of simplicity and not limitation, the description of such features is not repeated in connection herewith.

In this example, the blank 300 includes a main panel 302 having a pair of handle panels 304 extending therefrom along a somewhat arcuate score line, slit, or cut line 306. Other cut line shapes are contemplated hereby. Fold lines 308 extend between the score line or cut line 306 and the peripheral edge 310 of the blank 300. If desired, a microwave energy interactive element 312, for example, a susceptor, shield, or energy directing element, may overlie and be joined to at least a portion of the main panel 302, and optionally may define at least a portion a food contacting surface 314. The microwave energy interactive element also may overlie and be joined at least partially to the handle panels 304, as shown in FIG. 3A.

Figure 3B:
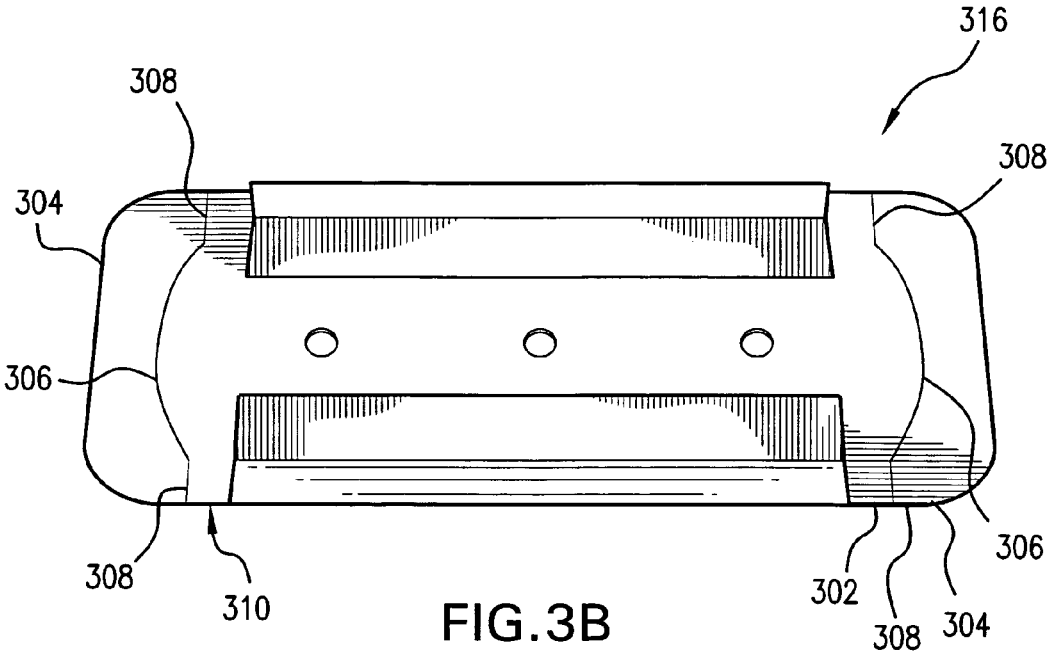
FIG. 3B depicts a bottom view of an exemplary construct formed from the blank of FIG. 3A, according to various aspects of the invention.
Figure 3C:
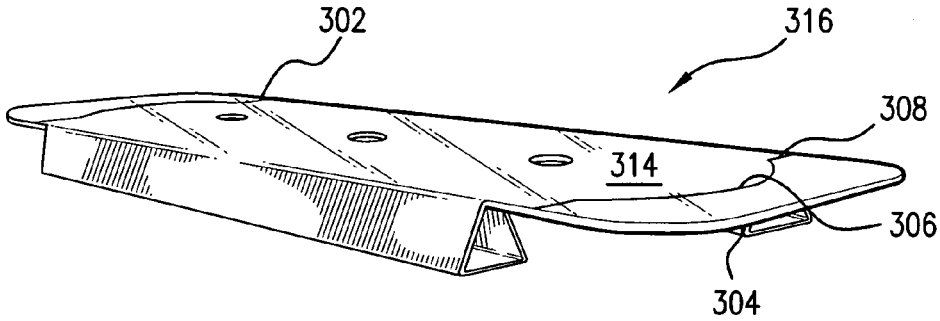
FIG. 3C depicts a perspective view of the exemplary construct of FIG. 3B, in an upright configuration, according to various aspects of the invention.
Figure 3D:
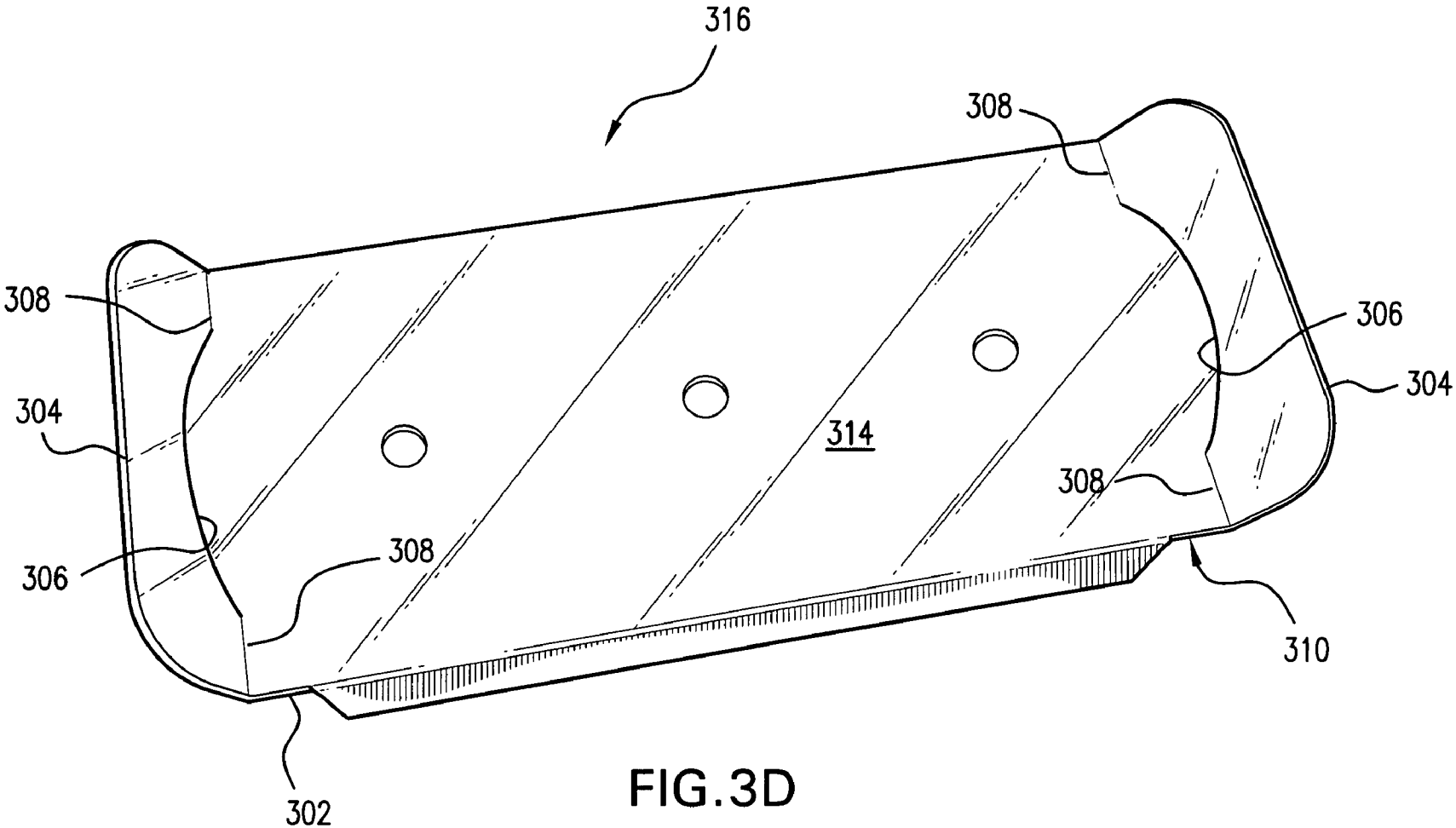
FIG. 3D depicts a perspective view of the exemplary construct of FIG. 3C, having handles in a partially upright position, according to various aspects of the invention.

Turning to FIG. 3B, the blank 300 may be formed into a tray 316 in a manner similar to that described in connection with the blank 200 of FIG. 2A. When inverted and positioned in an upright configuration as shown in FIG. 3C, the tray 316 is ready to be used. If desired, handle panels 304 may be folded toward the main panel 302 along score line or cut line 306 and fold lines 308 to create upwardly extending handles for grasping the tray 316, as shown in FIG. 3D. In this manner, contact with the food item (not shown) and/or platform 302, either or both of which may be hot, may be avoided substantially. Additionally, handles 304 may serve to secure the food item (not shown) on the platform 302.

Figure 4A:
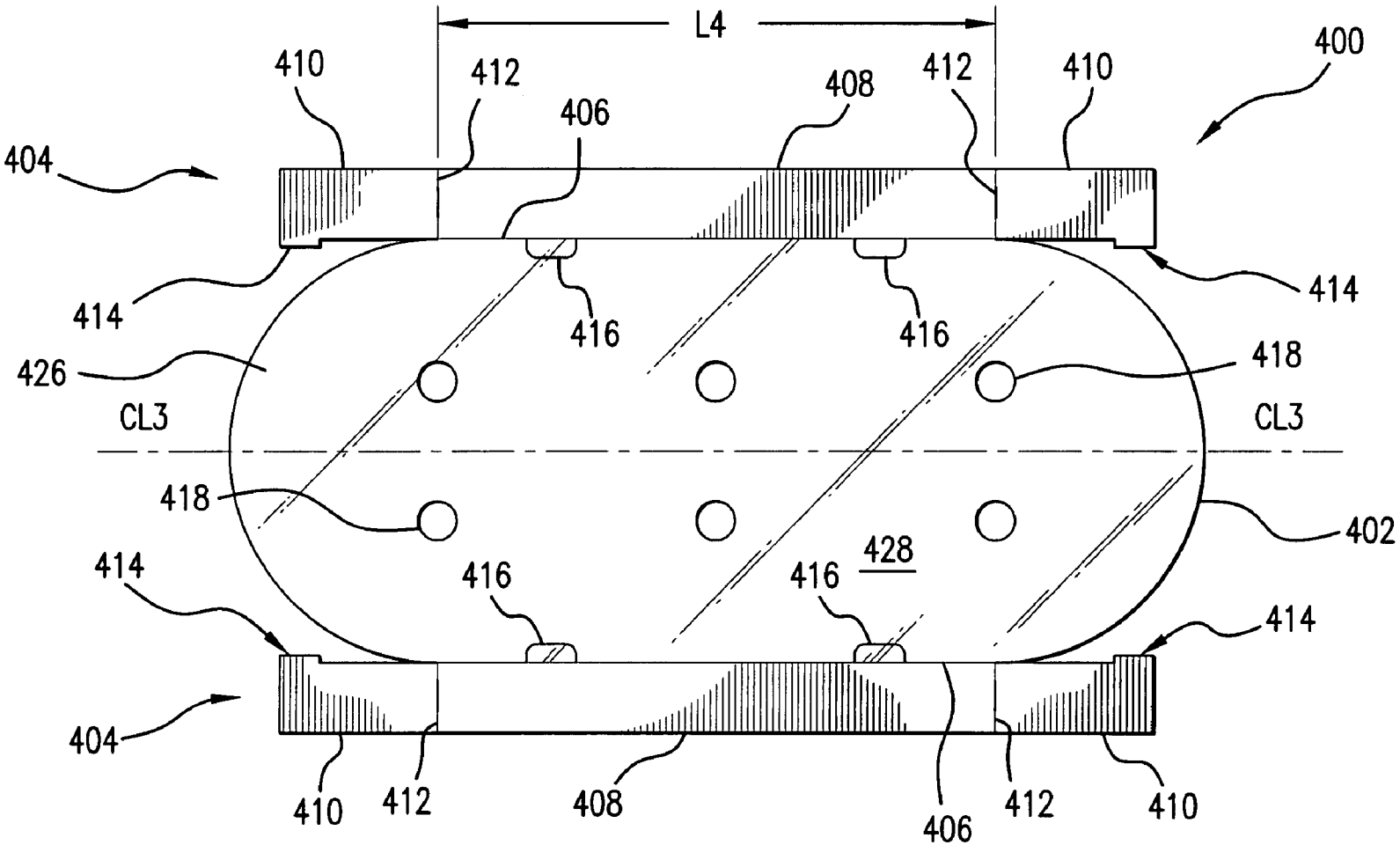
FIG. 4A depicts still another exemplary blank according to various aspects of the invention.

FIG. 4A depicts another exemplary blank 400 according to various aspects of the present invention. The blank 400 may be symmetric or nearly symmetric about a transverse center line CL3. Therefore, certain elements in the drawing figures may have similar or identical reference numerals to reflect the whole or partial symmetry.

The blank 400 includes a substantially oval main panel 402. However, in this and other aspects of the present invention, it will be understood that any shaped main panel may be used as desired. Substantially opposed leg portions 404 extend from the main panel 402 along fold lines 406. Each leg portion 404 comprises a plurality of minor panels including a first panel, for example, a central support panel 408, and a pair of hinged end panels 410. The central support panel 408 has a length that corresponds substantially to the length L4 of fold line 406. End panels 410 are joined to the central support panel 408 along end panel fold lines 412. A locking feature, in this example, a rectangular projection or tab 414, extends from an interior edge of each end panel 410 toward the main panel 402. If desired, the central support panel 408 may include one or more cuts or indentations, for example, somewhat C-shaped cut lines 416 to facilitate folding along fold lines 406.

Still viewing FIG. 4A, a plurality of apertures 418 extend through the thickness of the main panel 402. The apertures 418 are dimensioned and positioned to receive a locking feature 414 extending from each end panel 410. In this example, the apertures 418 are arranged in two rows, each having three apertures, spaced along opposed sides of centerline CL3. However, other configurations are contemplated hereby.

Figure 4B:
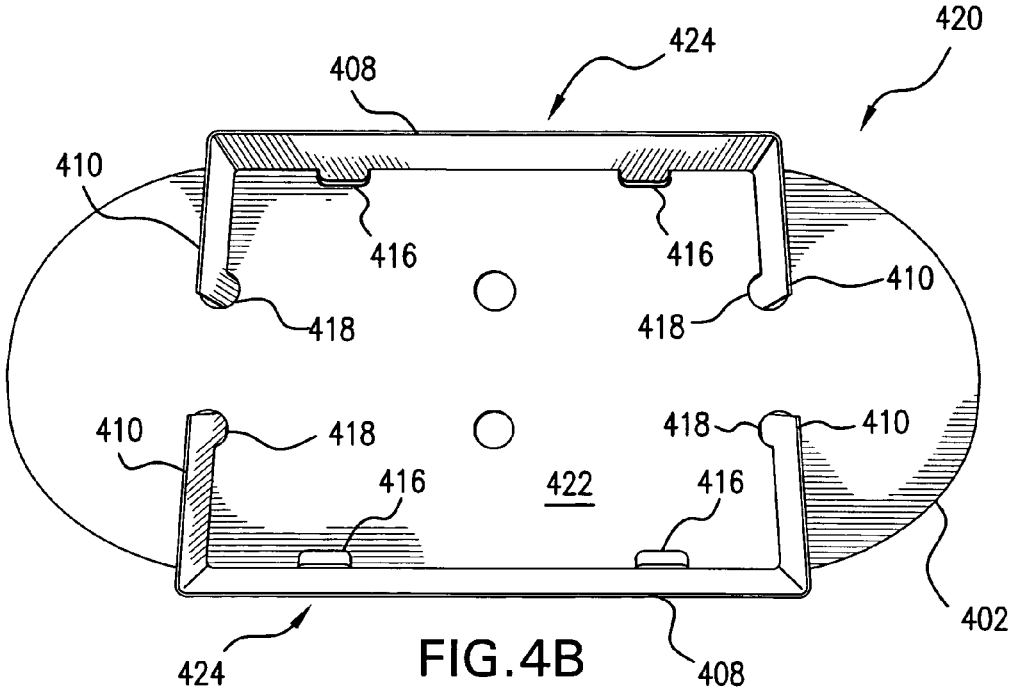
FIG. 4B depicts a bottom view of an exemplary construct formed from the blank of FIG. 4A, according to various aspects of the invention.
Figure 4C:
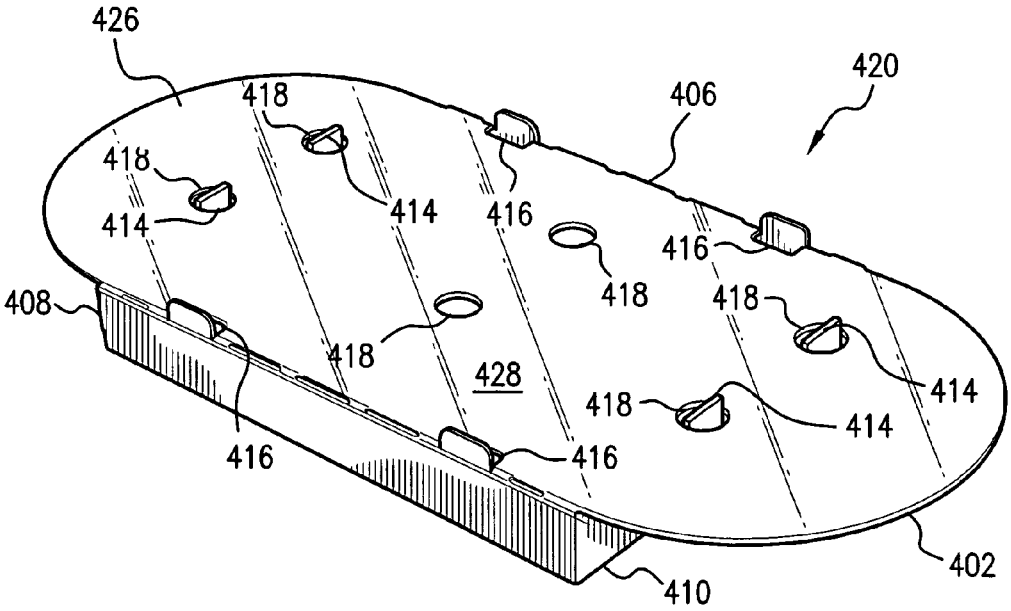
FIG. 4C depicts a top view of the construct of FIG. 4B, according to various aspects of the invention.

Now viewing FIGS. 4A-4C, to form the blank 400 into a tray 420, leg portions 404 may be folded toward a bottom surface 422 of the main panel 402 such that the leg portions 404 are substantially perpendicular to the main panel 402. The end panels 410 of each leg portion 404 may be folded toward each other along fold lines 412 such that the end panels 410 substantially form right angles with respect to the central support panel 408. Each locking feature 414 then may be aligned with and inserted into the appropriate corresponding or adjacent aperture 418. The locking feature 414 extends upwardly into the plane of the main panel 402, and may extend beyond the plane of the main panel 402, and locks into position (FIG. 4B) to form a pair of somewhat square C-shaped legs 424.

As shown in FIG. 4B, when the end panels 410 of this example are secured within the apertures 418, the end panels 410 are substantially perpendicular to the central support panel 408. In use, this leg configuration provides additional support to the platform along centerline CL3, as compared with a leg configuration in which no central support is provided.

FIG. 4C depicts the construct or tray 420 in an upright configuration. If desired, a microwave energy interactive element, for example, a susceptor 426, may overlie the platform 402 and form a portion of the food bearing surface 428. The resulting tray 420 may be used as described above with respect to the various other constructs of the invention.

Figure 5A:
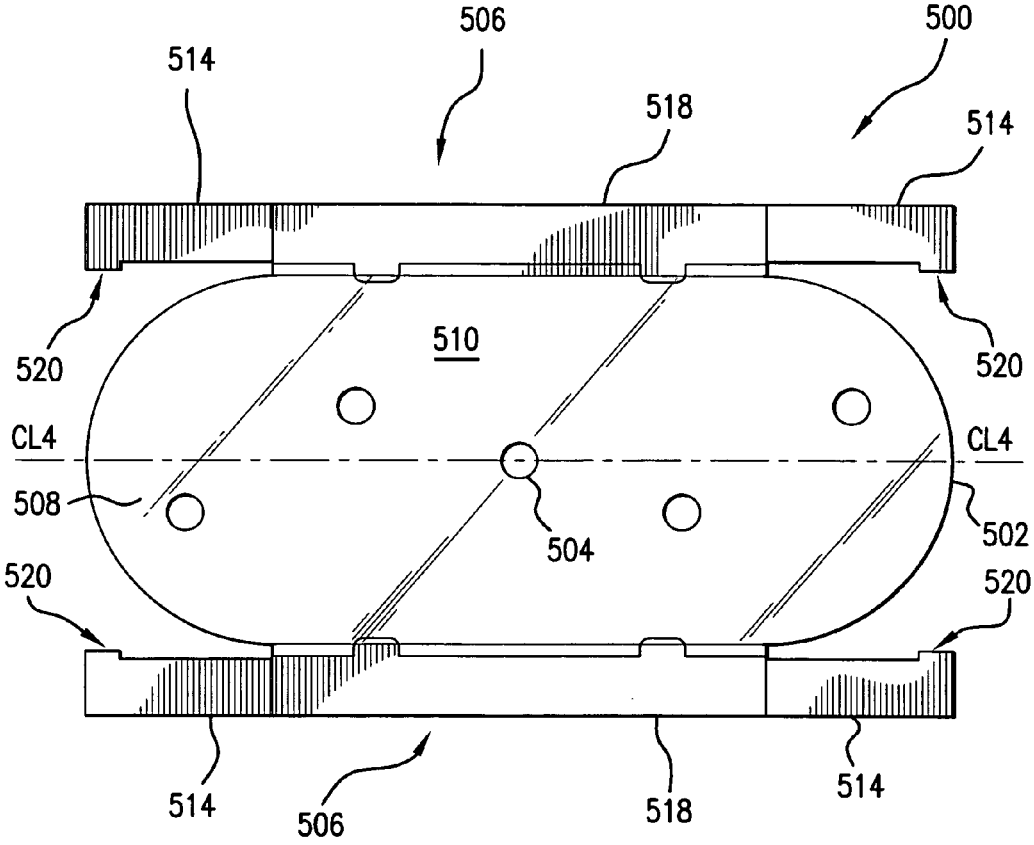
FIG. 5A depicts yet another exemplary blank according to various aspects of the invention.

FIG. 5A depicts yet another exemplary blank 500 according to various aspects of the present invention. The blank 500 includes features similar to that of blank 400 described in connection with FIG. 4A and, for purposes of simplicity and not limitation, such features are not described in connection herewith. Further, the blank 500 may be symmetric or nearly symmetric about a transverse center line CL4. Therefore, certain elements in the drawing figures may have similar or identical reference numerals to reflect the whole or partial symmetry.

In this example, the main panel 502 includes a plurality of apertures 504 arranged in an alternating, sinusoidal wavelike configuration extending between opposed leg portions 506. A microwave energy interactive element, in this example, a susceptor 508, overlies the main panel 502 to define at least a portion of a food-contacting surface 510.

Figure 5B:
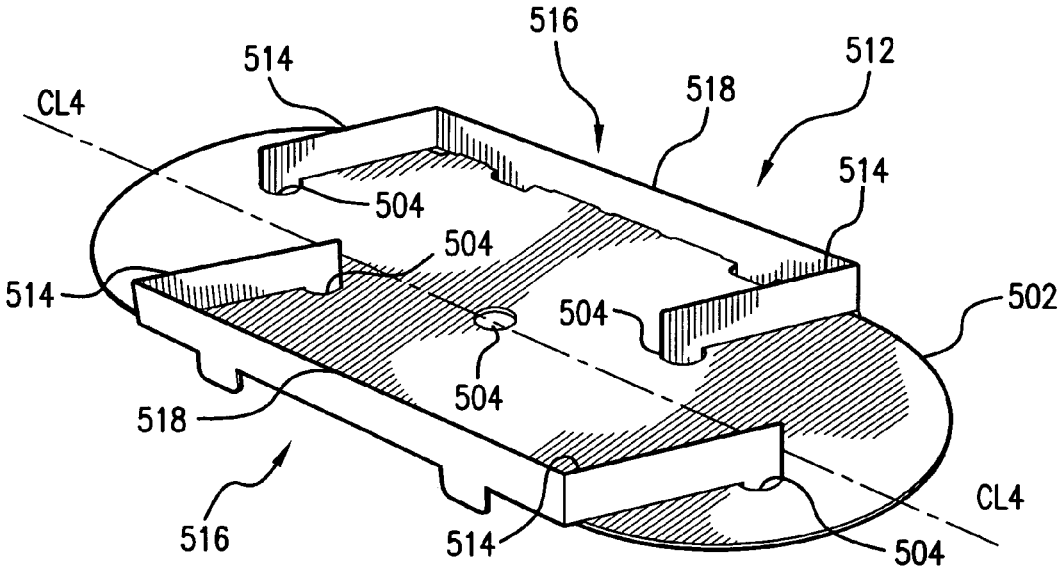
FIG. 5B depicts a bottom view of an exemplary construct formed from the blank of FIG. 5A, according to various aspects of the invention.
Figure 5C:
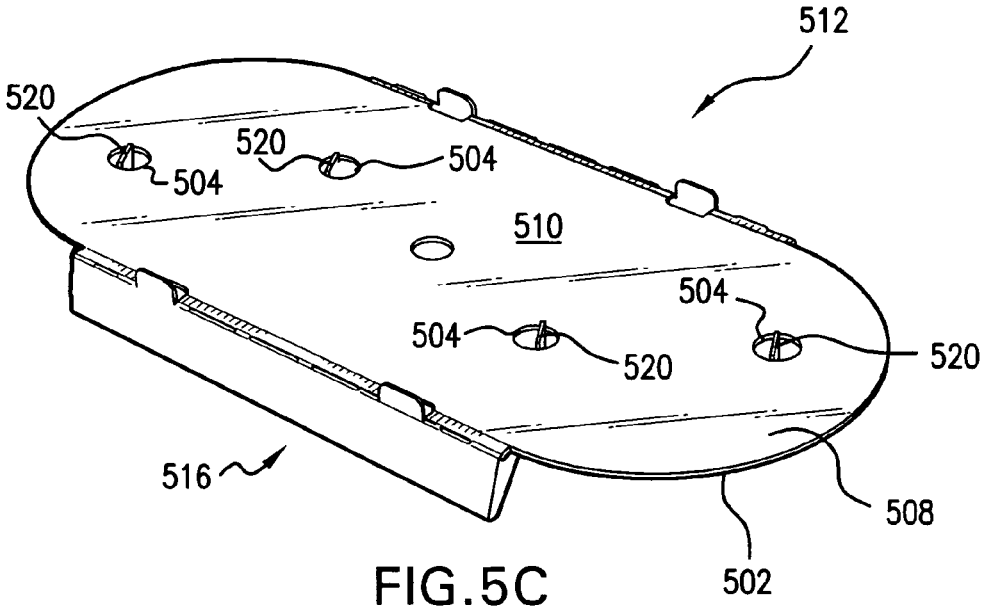
FIG. 5C depicts a top view of the construct of FIG. 5B, according to various aspects of the invention.

Turning to FIG. 5B, a construct, for example, a tray 512, may be formed from the blank 500 of FIG. 5A in a manner similar to that described in connection with FIGS. 4A-4C. In this example, however, the end panels 514 extend obliquely toward the centerline CL4 and lock within apertures 504 to form opposed, offset legs 516 that support to the platform 502. As is evident from FIG. 5B, some of the end panels 514 form an acute angle with respect to the central panel 518, and some of the end panels 514 form an obtuse angle with respect the central panel 518. FIG. 5C depicts the tray 512 in an upright configuration with the locking features 520 secured within the apertures 504. The tray 512 may be used as described above with respect to the various other constructs of the invention.

Figure 6A:
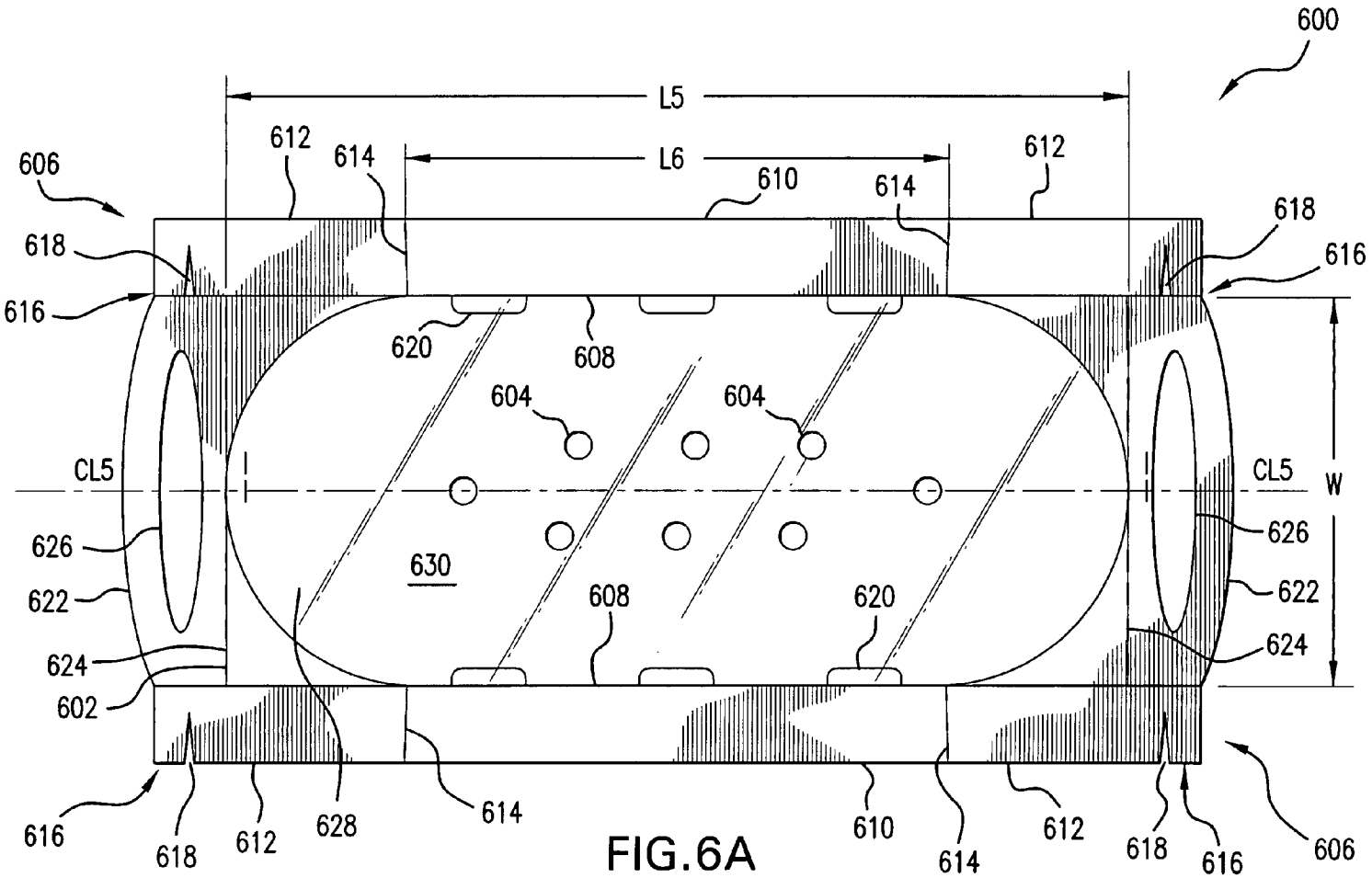
FIG. 6A depicts still another exemplary blank according to various aspects of the invention.

FIG. 6A depicts yet another exemplary blank 600 according to various aspects of the present invention. In this example, the blank 600 includes a somewhat rectangular main panel 602 having a first dimension or length L5 and a second dimension or width W. The main panel 602 includes a plurality of apertures 604 arranged proximate to centerline CL5, although other aperture configurations may be used.

Opposed leg portions 606 extend along the length of the main panel 602 along respective fold lines 608. Each leg portion 606 includes a central support panel 610 and a pair of end panels 612 joined to the central support panel 610 along end panel fold lines 614. The length of the central support panel 610 corresponds substantially to the length L6 of fold lines 608. A locking tab 616 or other feature defined by a somewhat v-shaped or triangular, notch or slit 618 terminates each end panel 612. If desired, the central support panel 610 may include one or more cut lines. 620 or indentations to facilitate folding along fold line 608.

Handle panels 622 extend from the main panel 602 along fold lines 624. Each handle panel 622 includes an elongate aperture 626 extending between the leg portions 606. A microwave energy interactive element, in this example, a substantially oval shaped susceptor 628, overlies at least a portion of the main panel 602 to define at least a portion of a food-contacting or food-bearing surface 630.

Figure 6B:
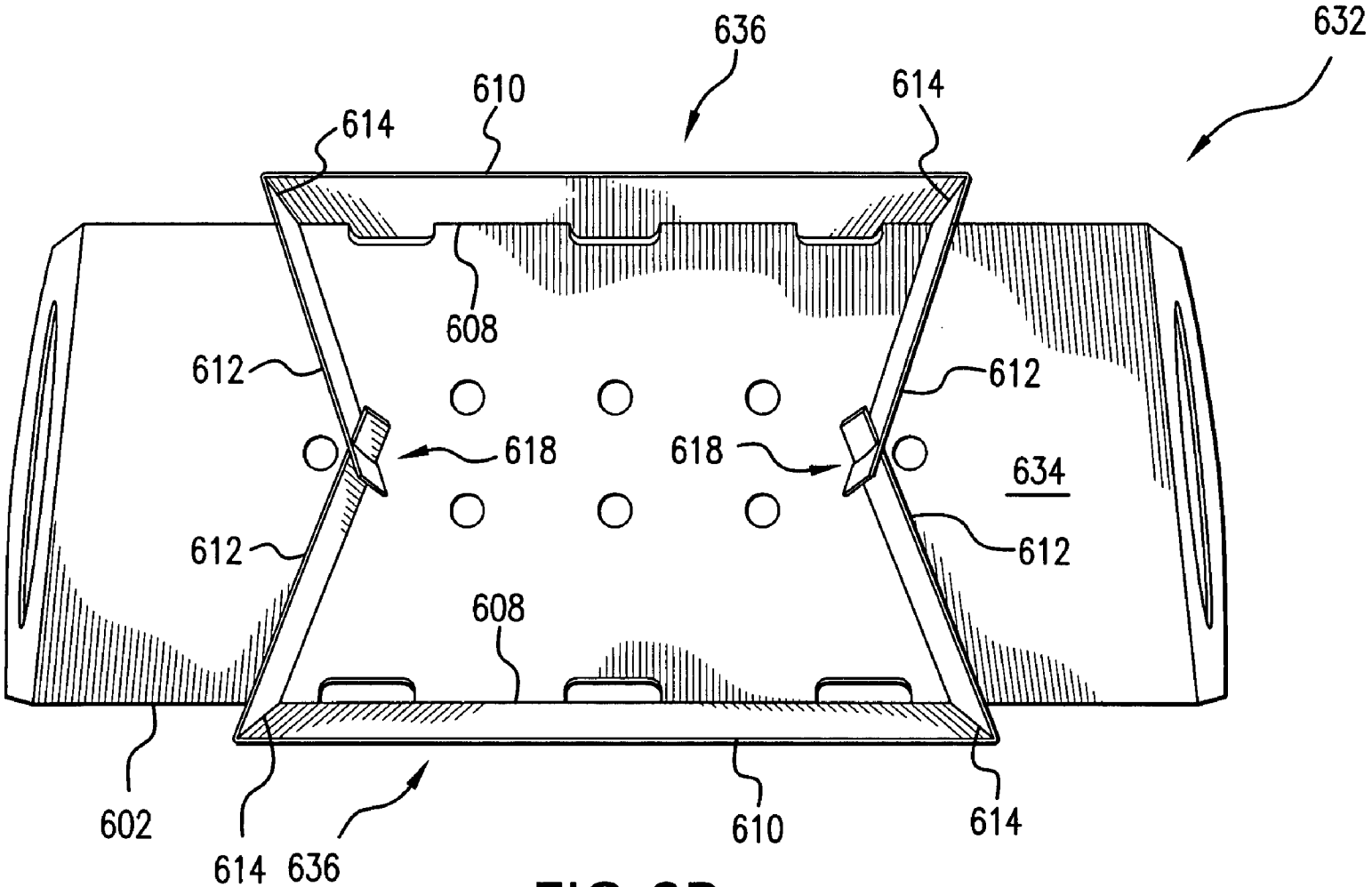
FIG. 6B depicts a bottom view of an exemplary construct formed from the blank of FIG. 6A, according to various aspects of the invention.
Figure 6C:
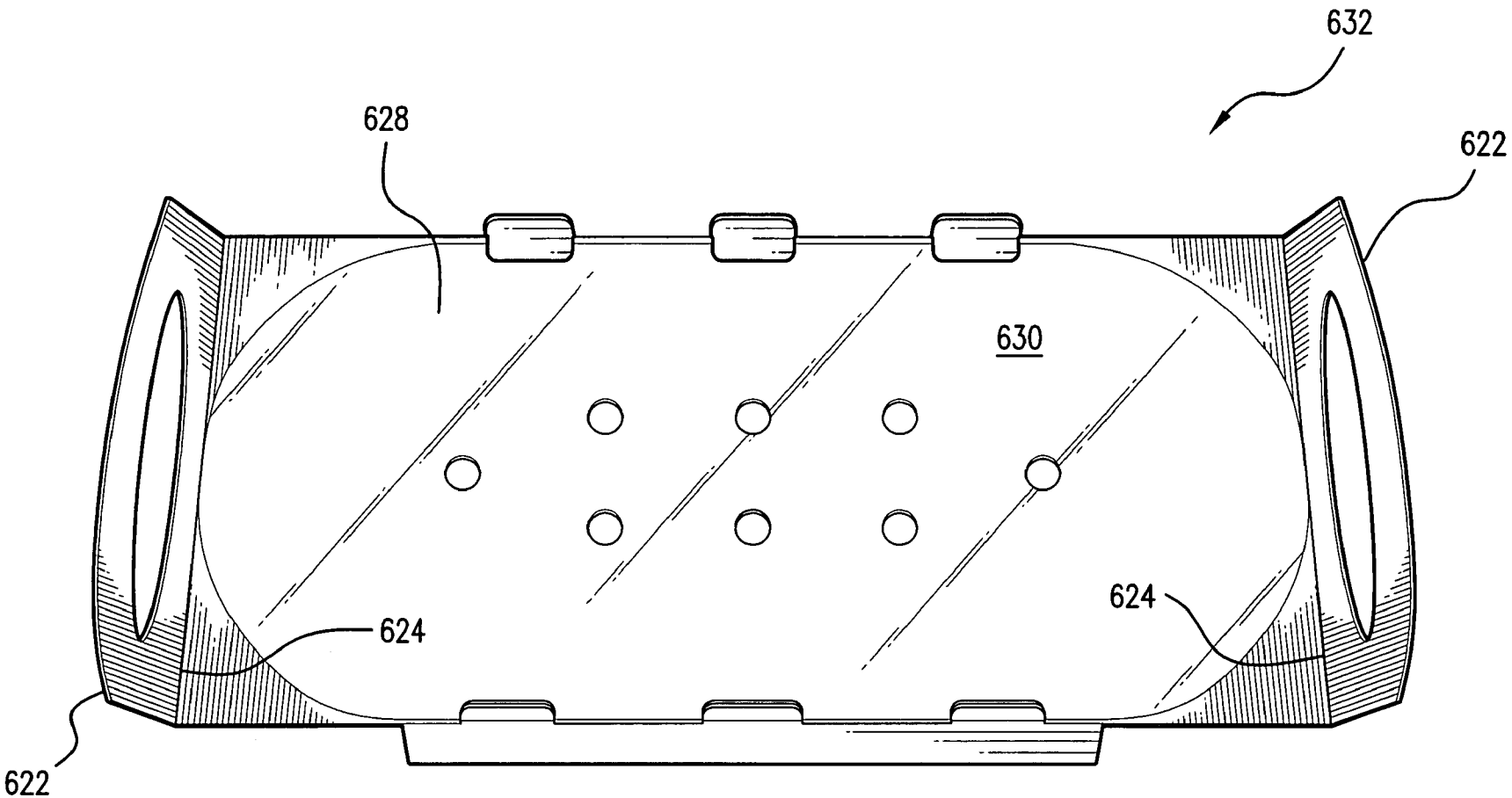
FIG. 6C depicts a top view of the construct of FIG. 6B, according to various aspects of the invention.

Now viewing FIGS. 6A-6C, to form a tray 632 from the blank 600, leg portions 606 may be folded toward a bottom surface 634 of the main panel 602 along fold lines 608 so that the central support panel 610 is substantially perpendicular to the main panel 602. Each pair of opposed end panels 612 then is brought together by folding along fold lines 614, and locked by interconnecting each pair of opposed notches 618 to form opposed, interconnected legs 636, as shown in FIG. 6B. As with various other aspects of this invention, this configuration provides strength to the platform 602 for supporting a food item (not shown) thereon. As shown in FIG. 6C, the handle panels 622 may be folded toward the food-bearing surface 630 of the platform 602 along fold lines 624 to provide a means of handling the tray 632.

Figure 7A:
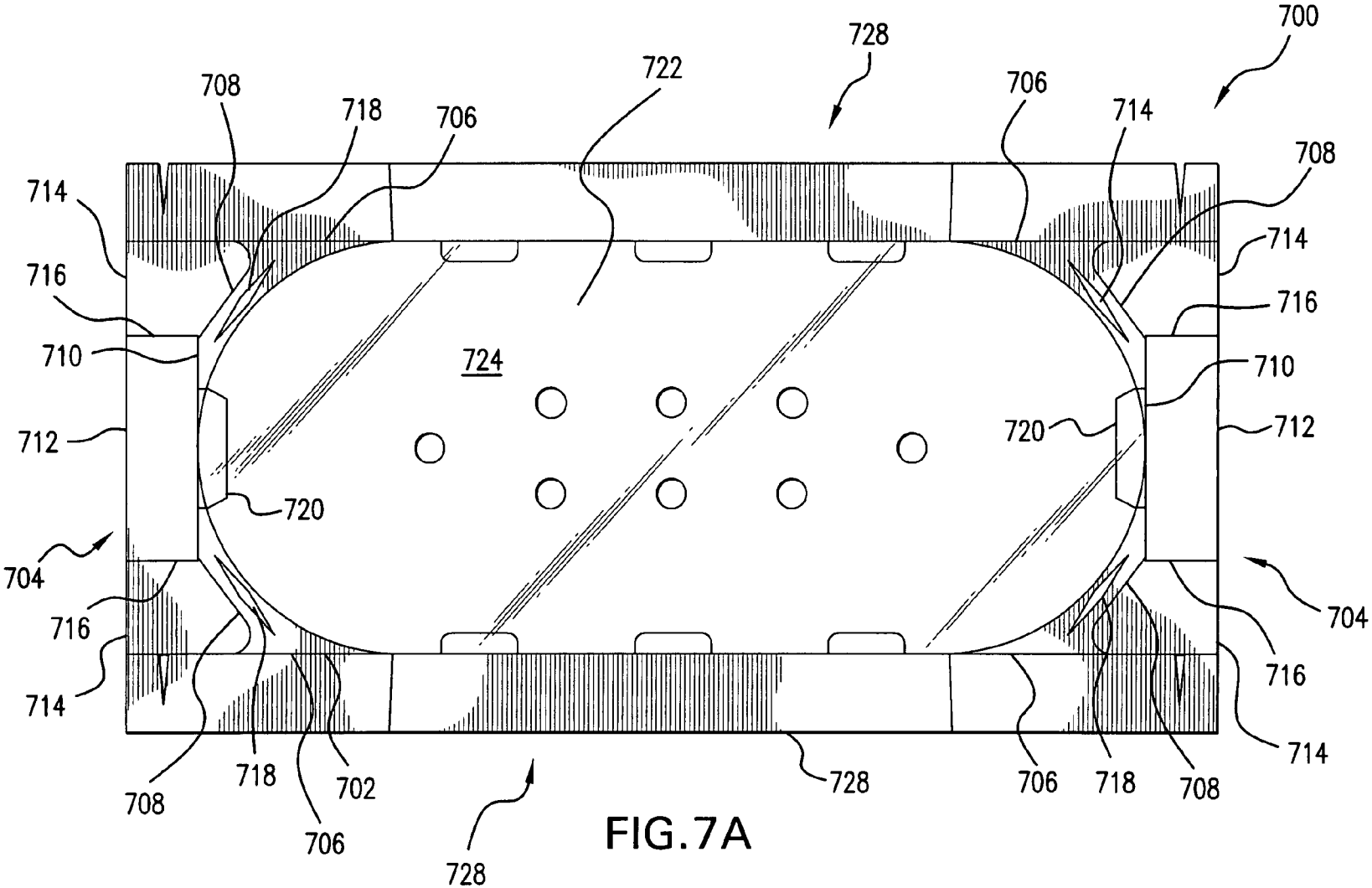
FIG. 7A depicts yet another exemplary blank according to various aspects of the invention.
Figure 7B:
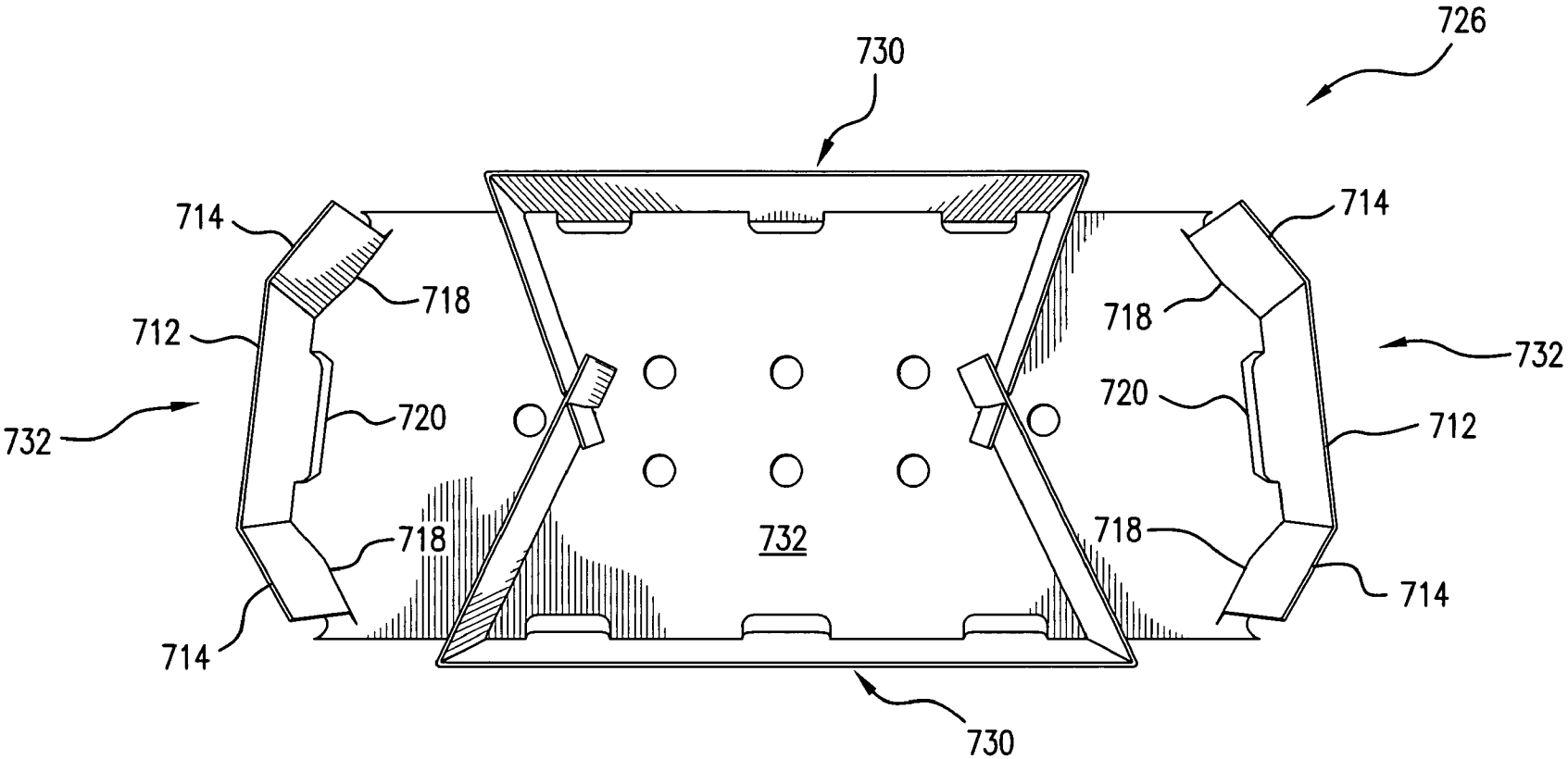
FIG. 7B depicts a bottom view of an exemplary construct formed from the blank of FIG. 7A, according to various aspects of the invention.

FIG. 7A depicts still another exemplary blank 700 according to various aspects of the present invention. The blank 700 includes some features similar to that of blank 600 described in connection with FIG. 6A and, for purposes of simplicity, such features are not described in detail in connection herewith.

In the example shown in FIG. 7A, the blank 700 includes a main panel 702 having end panels 704 defined partially by cut lines 706, oblique cut lines 708, and fold lines 710. Each end panel 704 includes a center panel 712 and a pair of bias cut end panels 714 joined to the center panel 712 along respective fold lines 716. The main panel 702 includes a plurality of slits 718 capable of receiving the bias cut side panels 714 adjacent to and aligned therewith. If desired, the blank 700 may include one or more cuts or indentations 720 to facilitate folding along fold lines 710. A somewhat obround microwave energy interactive element, for example, a susceptor 722, may overlie at least a portion of the main panel 702 to form at least a portion of a food-bearing surface 724.

Figure 7C:
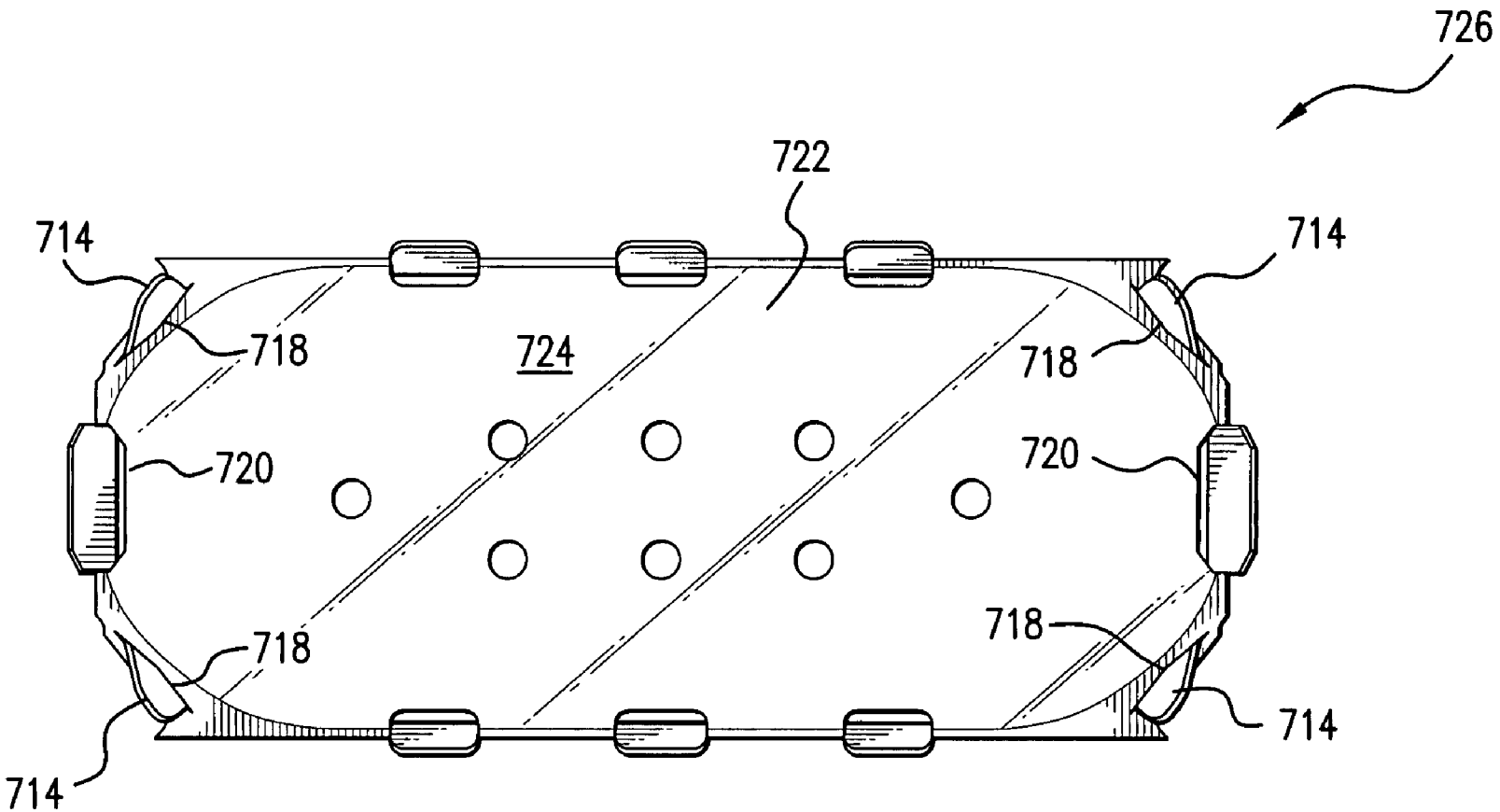
FIG. 7C depicts a top view of the construct of FIG. 7B, according to various aspects of the invention.

To form the blank 700 into a tray 726, opposed leg portions 728 may be folded and interlocked as described in connection with the blank 600 of FIG. 6B to form legs 730. End panels 704 may be folded toward the bottom surface 732 of the main panel 702. Side panels 714 may be folded along lines 716 toward the center panel 712 of the end panels 704 and inserted into the corresponding adjacent slits 718 to secure each end panel 704 into a locked position, thereby forming legs 732, as shown in FIG. 7C. The tray 726 may be used similarly to other constructs described herein.

Figure 8A:
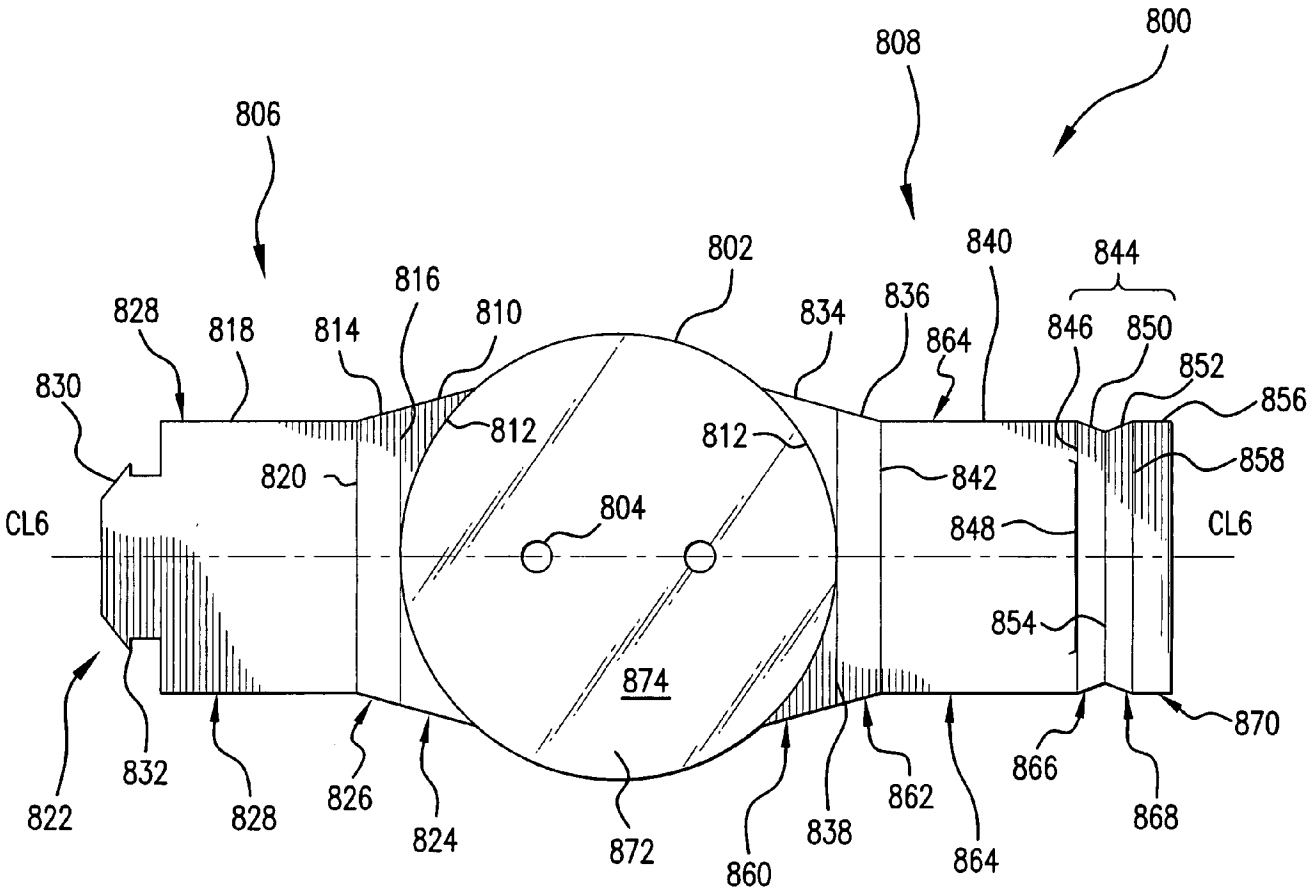
FIG. 8A depicts still another exemplary blank according to various aspects of the invention.

FIG. 8A depicts still another exemplary blank 800 according to various aspects of the invention. The blank 800 may be symmetric or nearly symmetric about a transverse center line CL6. Therefore, certain elements in the drawing figures may have similar or identical reference numerals to reflect the whole or partial symmetry.

The blank 800 includes a food-bearing panel or main panel 802. In this example, the main panel 802 is somewhat circular in shape, suitable, for example, for heating a pizza thereon. However, numerous other shapes and configurations may be used. The main panel 802 includes a plurality of substantially circular spaced apertures 804 positioned substantially along the transverse axis or centerline CL6. In this example, the main panel 802 includes two apertures 804 extending through the thickness of the blank 800. Other aperture configurations are contemplated hereby.

The blank 800 also includes a pair of leg portions 806, 808 extending from the main panel 802. Leg portions 806, 808 each include a plurality of minor panels joined by fold lines. In particular, a first leg portion 806 includes a connection portion 810 extending from the main panel 802 along a boundary 812, a first panel 814 joined to the connection portion 810 along a fold line 816, a second panel 818 joined to the first panel 814 along a fold line 820, and a tab 822 extending from the second panel 818. The connection portion 810 and the first panel 814 are somewhat tapered along their respective edges 824, 826 when viewed from the main panel 802 toward the tab 822. The second panel 818 is somewhat rectangular in shape with substantially parallel edges 828. However, it will be understood that other joining panel, leg panel, and main panel configurations may be used as needed to support adequately the platform of the package formed from the blank.

The tab 822 may have any suitable shape and configuration, and may be sized generally to be inserted within a receiving slot or other receiving feature or opening (discussed below). In this example, the tab 822 is positioned substantially centered along the centerline CL6 of the blank 800, and is substantially rectangular in shape with cambered corners 830 to resemble an arrow. If desired, juts 832 may be provided to secure the tab 822 when inserted into the receiving slot or other receiving feature (discussed below). While a tab is shown herein, it will be understood that other locking features may be used in accordance with the present invention. Thus, for example, a plurality of tabs or other locking features may be used, and such features may be aligned in any manner with any suitable spacing as needed or desired for a particular application.

Still viewing FIG. 8A, a second leg portion 808 includes a connection portion 834 extending from the main panel 802 along the boundary 812, a first panel 836 joined to the connection portion 834 along a fold line 838, a second panel 840 joined to the first panel 836 along a fold line 842, and a hinge portion 844 joined to the second panel 840 along a fold line 846. The fold line 846 is interrupted by an opening, for example, receiving slot 848 (referred to above). The hinge portion 844 includes a first hinge panel 850 joined to the main panel 840 along fold line 846, a second hinge panel 852 joined to the first hinge panel 850 along fold line 854, and a third hinge panel 856 joined to the second panel 850 along a fold line 858.

In this example, the connection portion 834 and the first panel 836 are somewhat tapered along their respective edges 860, 862 when viewed from the second panel 802 toward the hinge portion 844. Further, in this example, the second panel 840 is somewhat rectangular in shape with substantially parallel edges 864. The first hinge panel 850 is somewhat tapered along edges 866 from the second panel 840 to the second hinge panel 852, the second hinge panel 852 is somewhat reverse tapered along edges 868, and the third hinge panel 856 is somewhat rectangular in shape with substantially parallel edges 870. However, it will be understood that other panel configurations may be used as needed to support the platform of the package formed from the blank. If desired, a microwave energy interactive element, for example, a susceptor 872, may overlie all or a portion of the main panel 802 to form at least a portion of a food-contacting surface 874. In this example, the susceptor 872 defines the boundary 812 between the main panel 802 and the connection portions 810 and 834. However, other arrangements are contemplated hereby.

Figure 8B:
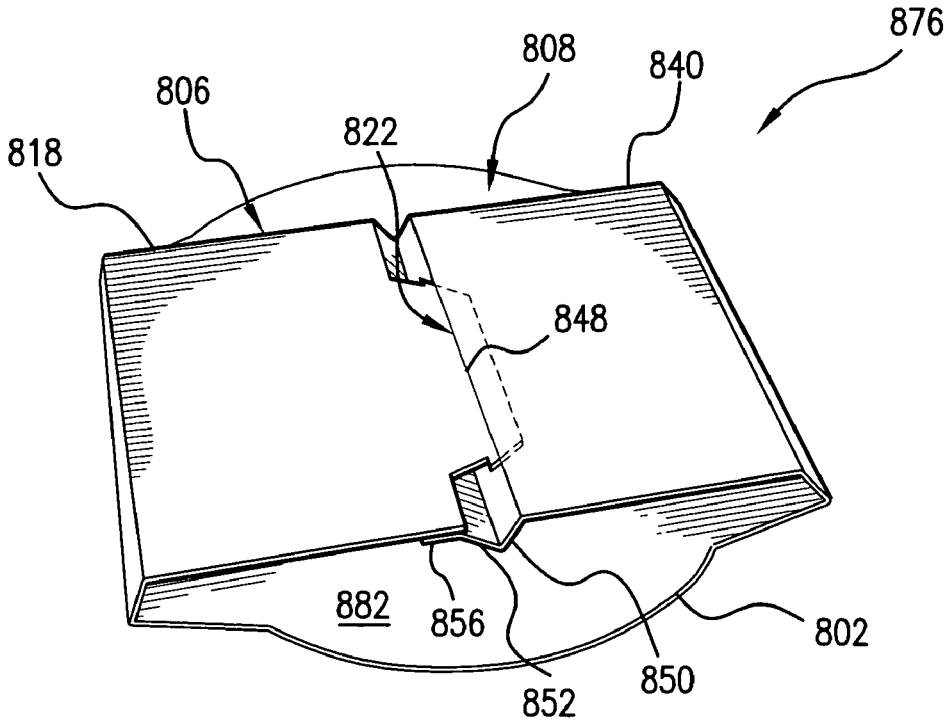
FIG. 8B depicts a bottom view of an exemplary construct formed from the blank of FIG. 8A, according to various aspects of the invention.
Figure 8C:
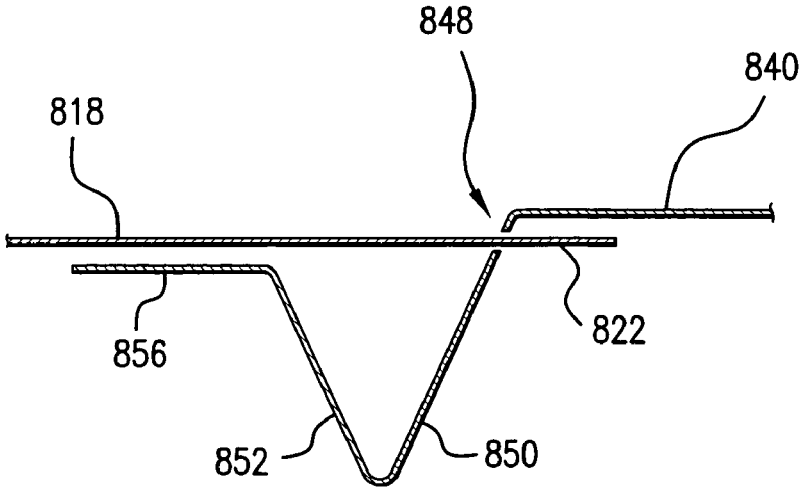
FIG. 8C depicts a schematic representation of a partial side view of the construct of FIG. 8B.
Figure 8D:
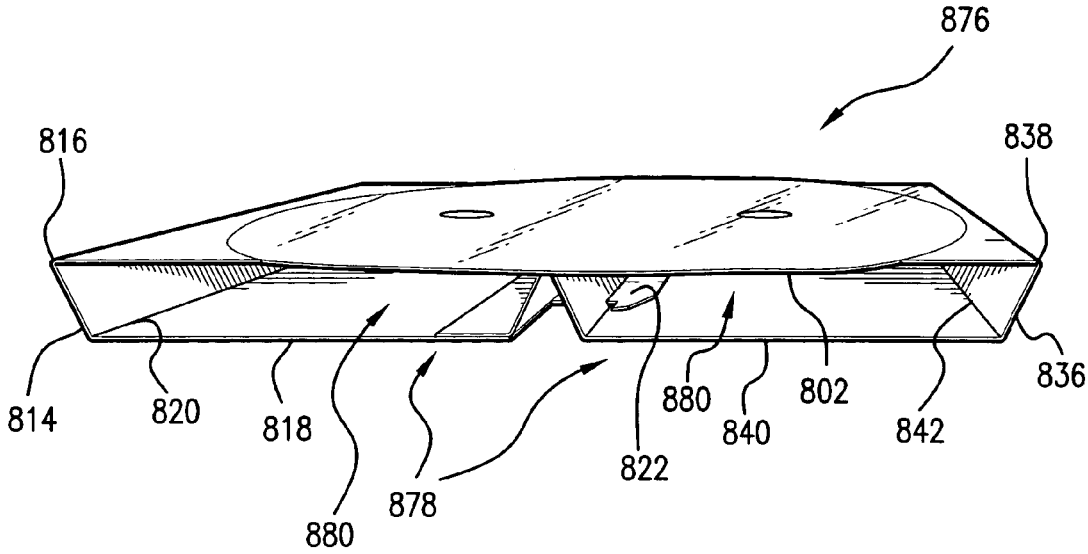
FIG. 8D depicts a side view of the construct of FIG. 8B.
Figure 8E:
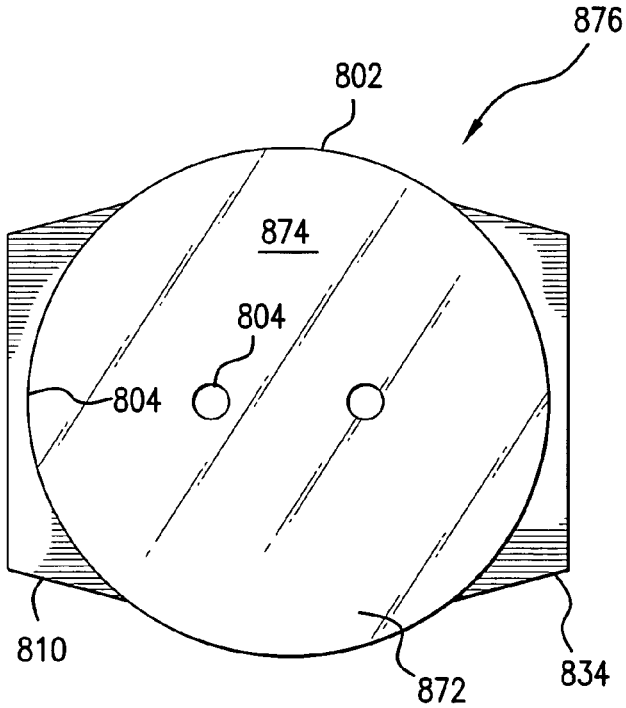
FIG. 8E depicts a top view of the construct of FIG. 8B formed from the blank of FIG. 8A, according to various aspects of the present invention.

As shown in FIGS. 8B-8E, to form the blank 800 into a construct, for example, a tray 876, the first leg portion 806 may be folded along fold lines 816 and 820. Likewise, second leg portion 808 may be folded along fold lines 838, 842, 846, 854, and 858. Leg portions 806 and 808 then may be brought toward each other such that the tab 822 is aligned with and can be inserted into the receiving slot 848, as shown in FIG. 8B. In doing so, the first hinge panel 850 and the second hinge panel 852 form a somewhat arcuate "V" or "U" configuration, with the third hinge panel 856 extending therefrom, as shown schematically in FIG. 8C. In this configuration, the third hinge panel 856 is superposed with at least a portion of the second panel 818 of the first leg portion 806. As shown in FIG. 8D, the folded and secured first leg portion 806 and second leg portion 808 form legs 878 that support the platform 802. In this example, a void or airspace 880 lies between the bottom surface 882 of the platform 802 and each of the main panels 818 and 840.

In use, a food item (not shown) is placed on the food-bearing surface 874 (FIG. 8E) of the platform 802, and the tray 876 with the food item thereon is placed in a microwave oven (not shown). The various panels of the first leg portion 806 and the second leg portion 808 cooperate to form legs 878 that support the platform 802 and maintain the food item at an elevated position in the microwave oven. In this and other aspects of the present invention, the air between the platform and the floor of the microwave oven provides an insulating effect, which decreases the heat loss to the microwave oven.

Additionally, the apertures 804 may provide venting of steam that is generated during heating, thereby improving browning and crisping of the food item.

While various leg configurations are shown herein, it will be understood that numerous other leg configurations are contemplated by the present invention. For example, if no insulation is desired, the void or airspace can be minimized or eliminated. Likewise, where venting apertures are not needed or desired, such features can be eliminated.

It will be understood that in each of the various blanks and trays described herein and contemplated hereby, a "fold line" can be any substantially linear, although not necessarily straight, form of weakening that facilitates folding therealong. More specifically, but not for the purpose of narrowing the scope of the present invention, a fold line may be a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; or any combination of these features.

While various examples of constructs are provided herein, it will be understood that any configuration of components may be used as needed or desired. The construct may be flexible, semi-rigid, rigid, or may include a variety of components having different degrees of flexibility. Additionally, it should be understood that the present invention contemplates constructs for single-serving portions and for multiple-serving portions. It also should be understood that various components used to form the constructs of the present invention may be interchanged. Thus, while only certain combinations are illustrated herein, numerous other combinations and configurations are contemplated hereby.

Although certain embodiments of this invention have been described with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be recognized by those skilled in the art, that various elements discussed with reference to the various embodiments may be interchanged to create entirely new embodiments coming within the scope of the present invention. It is intended that all matter contained in the above description or shown in the accompanying drawings shall be interpreted as illustrative only and not limiting. Changes in detail or structure may be made without departing from the spirit of the invention. The detailed description set forth herein is not intended nor is to be construed to limit the present invention or otherwise to exclude any such other embodiments, adaptations, variations, modifications, and equivalent arrangements of the present invention.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention and to provide the best mode contemplated by the inventor or inventors of carrying out the invention. The detailed description set forth herein is not intended nor is to be construed to limit the present invention or otherwise to exclude any such other embodiments, adaptations, variations, modifications, and equivalent arrangements of the present invention.

What is claimed is:

1. A construct for heating, browning, and/or crisping a food item in a microwave oven, comprising:

a platform for receiving the food item, the platform including a microwave energy interactive element; and a pair of opposed support elements joined to the platform along respective fold lines, wherein each fold line joining the respective support element to the platform is interrupted by a receiving slot substantially centered along the fold line, and each support element includes a locking feature dimensioned to be received within the respective receiving slot, the locking feature extending upwardly through the receiving slot such that a portion of the locking feature is positioned above the platform.

2. A construct for heating, browning, and/or crisping a food item in a microwave oven, comprising:

a platform for receiving the food item, the platform including a microwave energy interactive element; and a pair of opposed support elements joined to the platform along respective fold lines, each support element including a first panel extending substantially downwardly from the platform, a second panel foldably joined to the first panel, the second panel being substantially parallel to the platform, and a third panel foldably joined to the second panel, the third panel extending substantially upwardly towards the platform, wherein each fold line joining the respective support element to the platform is interrupted by a receiving slot substantially centered along the fold line, and each support element includes a locking feature dimensioned to be received within the respective receiving slot.

3. The construct of claim 2, wherein the first panel, the second panel, and the third panel define a substantially triangular shape in an elevational view of the support element.

4. The construct of claim 2, wherein the third panel includes the locking feature, and the locking feature received within the receiving slot extends obliquely and outwardly from a peripheral edge of the platform.

5. The construct of claim 1, wherein each locking feature comprises a tab that resembles an arrow.

6. The construct of claim 1, wherein the microwave energy interactive element comprises a layer of metal that converts at least a portion of impinging microwave energy to thermal energy.

7. The construct of claim 1, wherein the microwave energy interactive element comprises a susceptor.

8. A construct for heating, browning, and/or crisping a food item in a microwave oven, comprising:

a platform having an upper surface defined at least partially by a susceptor film;

a pair of support elements extending downwardly from the platform; and a locking feature extending upwardly from each support element through a slit disposed between the platform and the respective support element, wherein each support element comprises a plurality of foldably joined panels, and at least one panel of the plurality of foldably joined panels is disposed beneath the platform.

9. The construct of claim 8, wherein each support element comprises a plurality of adjoined panels that define a substantially triangular shape in an elevational view of the construct.

10. A construct for heating, browning, and/or crisping a food item in a microwave oven, comprising:

a platform having an upper surface defined at least partially by a susceptor film;

a pair of support elements extending downwardly from the platform, each support element including a first panel extending substantially downwardly from the platform, a second panel joined to the first panel, the second panel defining a lowermost portion of the respective support element, and a third panel joined to the second panel, the third panel extending obliquely and upwardly towards the platform; and a locking feature extending upwardly from each support element through a slit disposed between the platform and the respective support element.

11. The construct of claim 10, wherein each locking feature extends from the third panel of each respective support element.

12. The construct of claim 11, wherein each locking feature secures the respective support element in a locked position to maintain the platform in an elevated configuration.

13. A construct for heating, browning, and/or crisping a food item in a microwave oven, comprising:

a platform having a first dimension extending in a first direction and a second dimension extending in a second direction, the platform including a microwave energy interactive element; and a pair of opposed leg portions joined to the platform along respective fold lines extending in the first direction, each leg portion including a first panel extending downwardly from the platform, a second panel joined to the first panel, the second panel being substantially parallel to the platform, and a third panel extending from the second panel towards the platform.

14. The construct of claim 13, wherein each leg portion further includes a fourth panel foldably joined to the third panel.

15. The construct of claim 14, wherein the fourth panel extends downwardly towards the second panel.

16. The construct of claim 15, wherein the fourth panel and the first panel are in a substantially facing relationship.

17. The construct of claim 15, wherein the fourth panel and the third panel are in a substantially facing relationship.

18. The construct of claim 14, wherein the fourth panel extends obliquely from the third panel.

19. The construct of claim 14, wherein the fourth panel extends substantially perpendicularly from the third panel towards the first panel.

20. The construct of claim 14, wherein the fourth panel extends substantially perpendicularly from the third panel away from the first panel.

21. The construct of claim 13, further comprising a pair of substantially opposed handles joined to opposed ends of the platform along respective fold lines extending in the second direction, wherein each of the respective fold lines is interrupted by a slit.

22. The construct of claim 21, where the slit is substantially arcuate in shape.

23. The construct of claim 21, wherein the handles are adapted to hinge upwardly along the respective fold lines.

24. The construct of claim 23, wherein at least one of the handles forms an oblique angle with respect to the platform.

25. The construct of claim 23, wherein at least one of the handles forms a right angle with respect to the platform.

26. The construct of claim 13, wherein the microwave energy interactive element comprises a susceptor.

27. A construct for heating, browning, and/or crisping a food item in a microwave oven, comprising:

a platform comprising a microwave energy interactive element and a plurality of apertures; and a pair of opposed support elements joined to the platform along a pair of opposed edges of the platform, each support element including a center panel foldably joined to the platform, and a pair of end panels foldably joined to the center panel so that the end panels are disposed beneath the platform, wherein each end panel includes a locking feature adapted to extend upwardly through an aperture in the platform, the aperture being distal from the pair of opposed edges of the platform.

28. The construct of claim 27, wherein the center panel forms a substantially right angle with respect to the platform.

29. The construct of claim 28, wherein each end panel forms a substantially right angle with respect to the respective center panel.

30. The construct of claim 28, wherein at least one end panel forms an acute angle with respect to the respective center panel.

31. The construct of claim 28, wherein at least one end panel forms an obtuse angle with respect to the respective center panel.

32. The construct of claim 28, wherein at least one end panel forms an acute angle with respect to the respective center panel, and at least one end panel forms an obtuse angle with respect to the respective center panel.

33. The construct of claim 28, wherein each pair of end panels includes a first end panel and a second end panel, the first end panel forms a substantially acute angle with respect to the respective center panel, and the second end panel forms a substantially oblique angle with respect to the respective center panel.

34. The construct of claim 27, wherein the microwave energy interactive element comprises a susceptor.

35. A construct for heating, browning, and/or crisping a food item in a microwave oven, comprising:

a platform including a microwave energy interactive element, and a pair of side support elements, each support element including a central panel extending downwardly from a side edge of the platform, the side edge extending between a first end and a second end of the platform, and a pair of end panels foldably joined to each central panel beneath the platform, each pair of end panels including a first end panel proximate the first end of the platform and a second end panel proximate the second end of the platform, wherein the respective first end panels are adapted to engage one another, and the respective second end panels are adapted to engage one another.

36. The construct of claim 35, wherein each of the first end panels includes a notch, and the notch in one of the first end panels engages the notch in the other of the first end panels.

37. The construct of claim 36, wherein each of the second end panels includes a notch, and the notch in one of the second end panels engages the notch in the other of the second end panels.

38. The construct of claim 35, wherein each first end panel forms an acute angle with respect to the respective central panel, and each second end panel forms an acute angle with respect to the respective central panel.

39. The construct of claim 35, further comprising a pair of substantially opposed handles extending upwardly from the first end and the second end of the platform.

40. The construct of claim 39, wherein at least one handle of the pair of substantially opposed handles extends obliquely from the platform.

41. The construct of claim 35, further comprising a pair of substantially opposed end support elements respectively extending downwardly from the first end and the second end of the platform.

42. The construct of claim 41, wherein each end support element includes a center panel and a pair of substantially opposed bias cut side panels, the platform includes a receiving slot respectively adjacent to each bias cut panel of the pair of opposed bias cut side panels, and each receiving slot is dimensioned to receive at least a portion of the respective adjacent bias cut end panel.

43. The construct of claim 42, wherein each bias cut end panel forms an obtuse angle with respect to the center panel.

44. The construct of claim 41, wherein the side support elements and the end support elements maintain the platform in an elevated position.

45. The construct of claim 35, wherein the microwave energy interactive element comprises a susceptor.

46. A construct for heating, browning, and/or crisping a food item in a microwave oven, comprising:

a platform including a microwave energy interactive element; and a pair of support elements adapted to maintain the platform in an elevated position, the pair of support elements including a first support element and a second support element, wherein the first support element includes a first panel extending downwardly from the platform, a second panel joined to the first panel, the second panel being substantially parallel to the platform, and a locking feature, and the second support element includes a first panel extending downwardly from the platform, a second panel joined to the first panel, the second panel being substantially parallel to the platform, and third panel joined to the second panel along a fold line, wherein the fold line is interrupted by a slit dimensioned to receive the locking feature.

47. The construct of claim 1, wherein the locking features define a pair of upwardly extending handles for grasping the construct.

48. The construct of claim 1, wherein each support element comprises a first panel extending substantially downwardly from the platform, a second panel foldably joined to the first panel, the second panel being substantially parallel to the platform, and a third panel foldably joined to the second panel, the third panel extending substantially upwardly towards the platform.

49. The construct of claim 48, wherein the first panel, the second panel, and the third panel define a substantially triangular shape in an elevational view of the support element.

50. The construct of claim 8, wherein each support element comprises a first panel extending substantially downwardly from the platform, a second panel joined to the first panel, the second panel defining a lowermost portion of the respective support element, and a third panel joined to the second panel, the third panel extending obliquely and upwardly towards the platform.

* * * * *